US012583562B2

(12) United States Patent
Stroud et al.

(10) Patent No.: US 12,583,562 B2
(45) Date of Patent: Mar. 24, 2026

(54) MARINE MOUNT ANGLE CALIBRATION SYSTEM AND METHOD

(71) Applicant: Navico, Inc., Tulsa, OK (US)

(72) Inventors: Michael Duane Stroud, Grand Haven, MI (US); Jeremy J. Schroeder, Sapulpa, OK (US)

(73) Assignee: Navico, Inc., Tulsa, OK (US)

( * ) Notice: Subject to any disclaimer, the term of this patent is extended or adjusted under 35 U.S.C. 154(b) by 187 days.

(21) Appl. No.: 18/530,975

(22) Filed: Dec. 6, 2023

(65) Prior Publication Data

US 2025/0187709 A1 Jun. 12, 2025

(51) Int. Cl.

| | |
|---|---|
| ***B63B 79/30*** | (2020.01) |
| ***B63B 49/00*** | (2006.01) |
| ***B63B 79/10*** | (2020.01) |
| ***B63H 20/00*** | (2006.01) |

(52) U.S. Cl.

CPC ..... *B63B 79/30* (2020.01); *B63B 49/00* (2013.01); *B63B 79/10* (2020.01); *B63H 20/007* (2013.01)

(58) Field of Classification Search

CPC ..... B63B 79/30; B63B 79/10; B63B 49/00; B63H 20/007

See application file for complete search history.

(56) References Cited

U.S. PATENT DOCUMENTS

| | | | | |
|---|---|---|---|---|
| 9,928,611 | B2 | 3/2018 | Butterworth | |
| 2008/0269965 | A1* | 10/2008 | Luk-Paszyc | G01C 21/203 701/13 |
| 2022/0234490 | A1* | 7/2022 | Traub | B63C 3/12 |
| 2024/0109671 | A1* | 4/2024 | Neuman | G03B 15/006 |
| 2024/0296672 | A1* | 9/2024 | Beard | G05D 1/0094 |
| 2025/0121774 | A1* | 4/2025 | Han | H04N 23/90 |
| 2025/0128798 | A1* | 4/2025 | Kiji | G01S 7/4972 |

OTHER PUBLICATIONS

Lowrance | Good and Bad TotalScan™ Transducer Installations; retrieved Dec. 6, 2023 from https://www.youtube.com/watch?v=m7k0ECCQjeY.

* cited by examiner

*Primary Examiner* — Naeem Taslim Alam

(74) *Attorney, Agent, or Firm* — Nelson Mullins Riley & Scarborough LLP

(57) ABSTRACT

A system is provided for determining an angular offset for a device attached to a watercraft. The system comprises an electronic device including a camera, one or more processors, and a memory including computer program code. The computer program code is configured to, when executed, cause the one or more processors to determine, based on an image via the camera, a first direction associated with the watercraft. The image includes at least a portion of the watercraft and at least a portion of the device mounted to the watercraft. The computer program code is also configured to, when executed, determine, based on the image via the camera, a second direction associated with the device, determine an angular offset between the first direction and the second direction, and store an indication of the angular offset in the memory for use with one or more functions associated with the device.

19 Claims, 16 Drawing Sheets

MARINE MOUNT ANGLE CALIBRATION SYSTEM AND METHOD

FIELD

Embodiments relate generally to systems, devices, and methods that are used to automatically identify offset of installed devices on a watercraft, such as for improved functionality of such devices relative to the watercraft.

BACKGROUND

When manually installing devices on watercraft, users often face issues with being confident in how to mount and align devices with respect to the watercraft. The devices may be installed improperly, or they may be installed properly, but the user may fail to determine a proper offset between the device direction and the watercraft direction to apply in memory for proper device functioning with respect to the watercraft. Users frequently attempt to install the devices without the aid of any other tools, leading to inaccuracies in installation. In some cases, equipment such as trolling motors may be misaligned by forty degrees or more. Users are often required to make repeated attempts to properly calibrate devices through trial and error until devices are correctly installed. Repeated attempts at calibration can be time consuming for users and may cause a significant amount of frustration for users. When attempting to use improperly calibrated devices such as a trolling motor or another motor, users may repeatedly miss their intended target and may instead circle around the target, leading to significant frustration for the user and wasting of time for the user.

BRIEF SUMMARY

Systems, devices, and methods described in various embodiments herein result in increased accuracy in the calibration of devices on a watercraft. Various embodiments herein accurately and automatically identify an offset so that this offset may be utilized to determine relative position and/or orientation. Once offset has been identified, the identified amount of offset may be saved and used by other systems. Additionally, or alternatively, once the offset has been identified, one or more indicators of the offset may be provided on an image in devices or in the form of text notifications. This may prevent the user being required to make repeated attempts to install/calibrate devices on a watercraft.

A user may use a camera to view an image of a device after initial installation of the device on a watercraft (e.g., in a live camera view or via a taken image). Image processing techniques may be utilized to identify edges of the device and the watercraft that are represented in the image. These image processing techniques may be formed and/or optimized using machine learning or artificial intelligence. Once edges of the device and the watercraft are identified, relevant lines or directions for the device and the watercraft may be identified, allowing the offset for the device from the appropriate position to be properly determined.

In an example embodiment, a system is provided for determining an angular offset for a device attached to a watercraft. The system comprises an electronic device including a camera. The system also comprises one or more processors and a memory including computer program code configured to, when executed, cause the one or more processors to perform various tasks. These tasks include determining, based on an image via the camera, a first direction associated with the watercraft. The image includes at least a portion of the watercraft and at least a portion of the device mounted to the watercraft. The tasks also include determining, based on the image via the camera, a second direction associated with the device, determining an angular offset between the first direction and the second direction, and storing an indication of the angular offset in the memory for use with one or more functions associated with the device.

In some embodiments, the computer program code may be configured to, when executed, cause the one or more processors to determine the first direction associated with the watercraft and determine the second direction associated with the device based on a still image taken by the camera.

In some embodiments, determining the first direction associated with the watercraft based on the image may be accomplished using image processing. Additionally, in some embodiments, determining the first direction associated with the watercraft may be performed using a Hough transform. Furthermore, in some embodiments, the Hough transform may use points on the watercraft to determine the first direction associated with the watercraft, and the points on the watercraft may be positioned on a bow of the watercraft. In some embodiments, the one or more processors may be configured to utilize a model when using the image processing to determine the first direction associated with the watercraft based on the image. The model may be formed based on historical comparisons of with historical shape data for a watercraft or a device and historical additional data, and the model may be developed through machine learning utilizing artificial intelligence.

In some embodiments, the device may be a component of a trolling motor assembly, and the second direction may be a forward direction of the component of the trolling motor assembly extending outwardly from the watercraft.

In some embodiments, the electronic device may comprise a display, and the computer program code may be configured to, when executed, cause the one or more processors to present a representation of the angular offset on the display. Additionally, in some embodiments, presenting the representation of the angular offset on the display may include presenting text to the user indicating the amount of angular offset. Furthermore, in some embodiments, presenting the representation of the angular offset on the display may include presenting one or more indicators on a live image showing the device, and the indicators may indicate a magnitude of the angular offset.

In some embodiments, the electronic device may be at least one of a cell phone, a tablet, a laptop, a smart watch, or smart glasses. In some embodiments, the image may be taken from a position above the device. In some embodiments, the device may be a sonar transducer, the first direction associated with the watercraft may be a rearward direction of the watercraft, and the second direction may be a pointing direction of the sonar transducer extending outwardly from the watercraft.

In another example embodiment, an electronic device for determining an angular offset for a device attached to a watercraft is provided. The electronic device comprises a camera, one or more processors, and a memory including computer program code configured to, when executed, cause the one or more processors to perform various tasks. The tasks include determining, based on an image via the camera, a first direction associated with the watercraft. The image includes at least a portion of the watercraft and at least a portion of the device mounted to the watercraft. The tasks also include determining, based on the image via the camera, a second direction associated with the device, determining an angular offset between the first direction and the second direction, and storing an indication of the angular offset in the memory for use with one or more functions associated with the device.

In some embodiments, the electronic device may be at least one of a cell phone, a smart phone, a tablet, a laptop, a smart watch, or smart glasses.

In some embodiments, the computer program code may be configured to, when executed, cause the one or more processors to determine the first direction associated with the watercraft and determine the second direction associated with the watercraft based on a still image taken from the camera. In some embodiments, determining the first direction associated with the watercraft based on the image may be accomplished using image processing. Furthermore, in some embodiments, determining the first direction associated with the watercraft may be performed using a Hough transform.

In another example embodiment, a method for determining an angular offset for a device attached to a watercraft is provided. The method comprises determining, based on an image via the camera, a first direction associated with the watercraft. The image includes at least a portion of the watercraft and at least a portion of the device mounted to the watercraft. The method also includes determining, based on the image via the camera, a second direction associated with the device. The method also includes determining an angular offset between the first direction and the second direction and storing an indication of the angular offset in the memory for use with one or more functions associated with the device. In some embodiments, the method may also include determining the first direction associated with the watercraft and determining the second direction associated with the watercraft based on a live image from the camera.

BRIEF DESCRIPTION OF THE DRAWINGS

Reference will now be made to the accompanying drawings, which are not necessarily drawn to scale, and wherein.

DETAILED DESCRIPTION

Figure 1A:
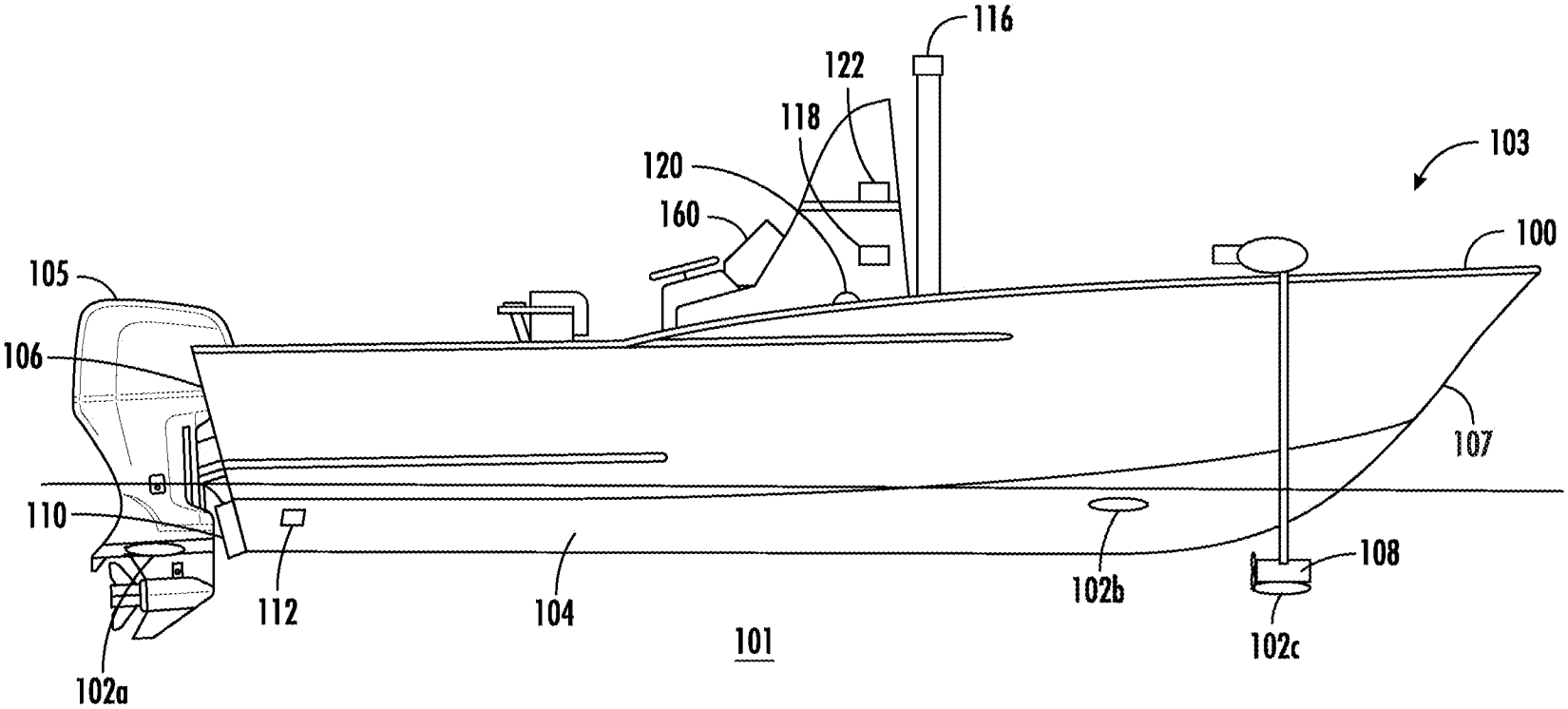
FIG. 1A is a schematic view illustrating an example watercraft including various marine devices, in accordance with some embodiments discussed herein.

Example embodiments now will be described more fully hereinafter with reference to the accompanying drawings, in which some, but not all embodiments are shown. For FIGS. 1-6, like reference numerals generally refer to like elements. For example, reference numbers 100, 200, 300, etc. are used for the watercraft or representations of the watercraft. Additionally, any connections or attachments may be direct or indirect connections or attachments unless specifically noted otherwise.

FIG. 1A illustrates an example watercraft 100 including various marine devices, in accordance with some embodiments discussed herein. As depicted in FIG. 1A, the watercraft 100 (e.g., a vessel) is configured to traverse a marine environment, e.g. body of water 101, and may use one or more sonar transducer assemblies 102A, 102B, and 102C disposed on and/or proximate to the watercraft. Notably, example watercraft contemplated herein may be surface watercraft, submersible watercraft, or any other implementation known to those skilled in the art. The sonar transducer assemblies 102A, 102B, and 102C may each include one or more transducer elements (such as in the form of the example assemblies described herein) configured to transmit sound waves into a body of water, receive sonar returns from the body of water, and convert the sonar returns into sonar return data. Various types of sonar transducers may be provided—for example, a linear downscan sonar transducer, a conical downscan sonar transducer, a sonar transducer array, or a sidescan sonar transducer may be used. Each of the sonar transducer assemblies 102A, 102B, 102C are configured to provide sonar data that may be stored and that may undergo further processing to form sonar images. The sonar data may include information representative of an underwater environment around a watercraft.

Depending on the configuration, the watercraft 100 may include a primary motor 105, which may be a main propulsion motor such as an outboard or inboard motor. Additionally, the watercraft 100 may include a trolling motor 108 configured to propel the watercraft 100 or maintain a position. The one or more sonar transducer assemblies (e.g., 102A, 102B, and/or 102C) may be mounted in various positions and to various portions of the watercraft 100 and/or equipment associated with the watercraft 100. For example, the transducer assembly may be mounted proximate to the transom 106 of the watercraft 100, such as depicted by sonar transducer assembly 102A. The transducer assembly may be mounted to the bottom or side of the hull 104 of the watercraft 100, such as depicted by sonar transducer assembly 102B. The transducer assembly may also be mounted to the trolling motor 108, such as depicted by sonar transducer assembly 102C.

The watercraft 100 may also include one or more marine electronic devices 160, such as may be utilized by a user to interact with, view, or otherwise control various aspects of the various sonar systems described herein. In the illustrated embodiment, the marine electronic device 160 is positioned proximate the helm (e.g., steering wheel) of the watercraft 100—although other locations on the watercraft 100 are contemplated. Likewise, additionally or alternatively, a remote device (such as a user's mobile device) may include functionality of a marine electronic device.

The watercraft 100 may also comprise other components within the one or more marine electronic devices 160 or at the helm. In FIG. 1A, the watercraft 100 comprises a radar 116, which is mounted at an elevated position (although other positions relative to the watercraft are also contemplated). The watercraft 100 also comprises an AIS transceiver 118, a direction sensor 120, and a camera 122, and these components are each positioned at or near the helm (although other positions relative to the watercraft 100 are also contemplated). Additionally, the watercraft 100 comprises a rudder 110 at the stern of the watercraft 100, and the rudder 110 may be positioned on the watercraft 100 so that the rudder 110 will rest in the body of water 101. In other embodiments, these components may be integrated into the one or more electronic devices 160 or other devices. Another example device on the watercraft 100 includes a temperature sensor 112 that may be positioned so that it will rest within or outside of the body of water 101. Other example devices include a wind sensor, one or more speakers, and various vessel devices/features (e.g., doors, bilge pump, fuel tank, etc.), among other things. Additionally, one or more sensors may be associated with marine devices; for example, a sensor may be provided to detect the position of the primary motor 105, the trolling motor 108, or the rudder 110. The watercraft 100 includes a bow 103 at the front end of the watercraft 100, and the watercraft 100 includes a keel 107, which may extend along a centerline of the watercraft 100 and generally along the forward direction of the watercraft 100.

Figure 1B:
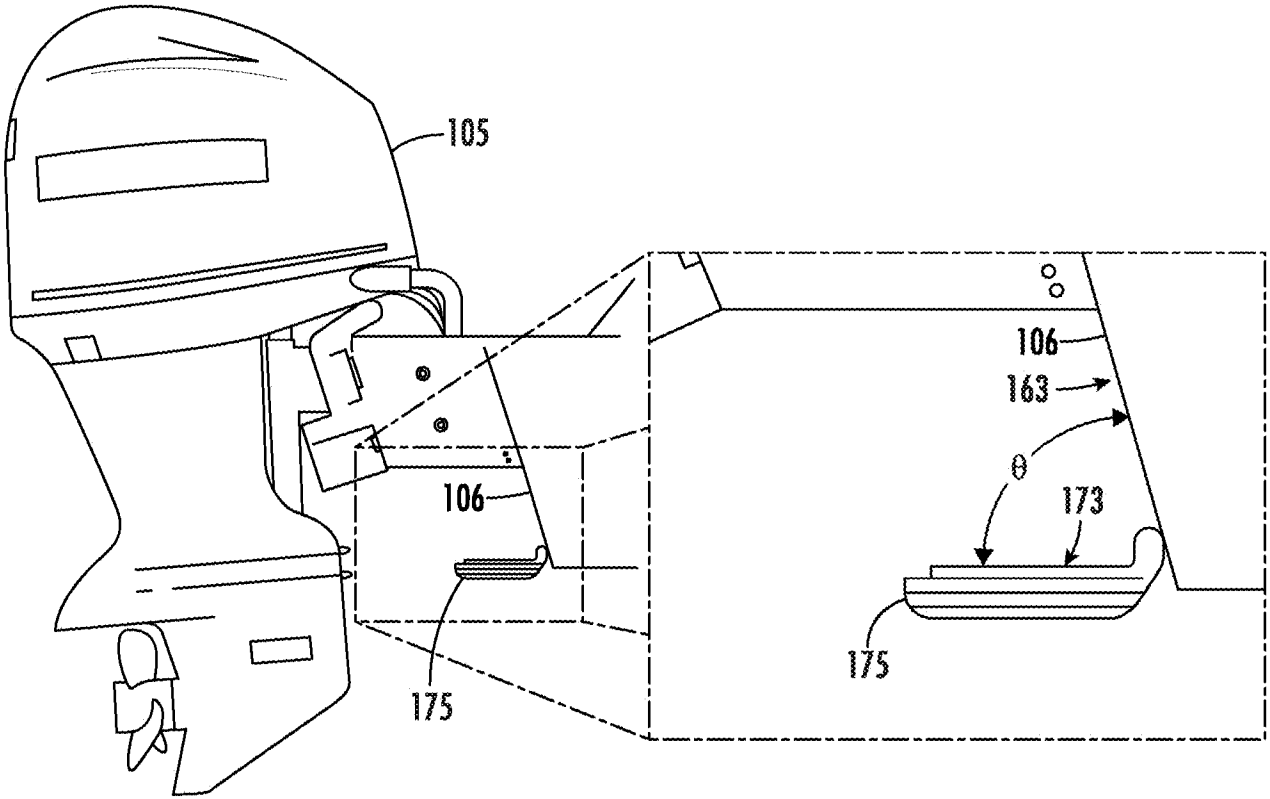
FIG. 1B is a schematic view illustrating an example watercraft including a sonar transducer assembly attached to a transom of the watercraft, in accordance with some embodiments discussed herein.

One or more sonar transducer assemblies may be attached at different locations on a watercraft. One example location where a sonar transducer assembly may be attached is at the transom of a watercraft, and FIG. 1B illustrates an example of a sonar transducer assembly 175 attached at the transom 106 of the watercraft 100. The sonar transducer assembly 175 may be attached at the transom 106 with the top surface 173 of the sonar transducer assembly 175 being offset from the back surface 163 at the transom 106 by an angle θ. This angle θ may be adjusted so that the sonar transducer assembly 175 is positioned appropriately.

Figure 1C:
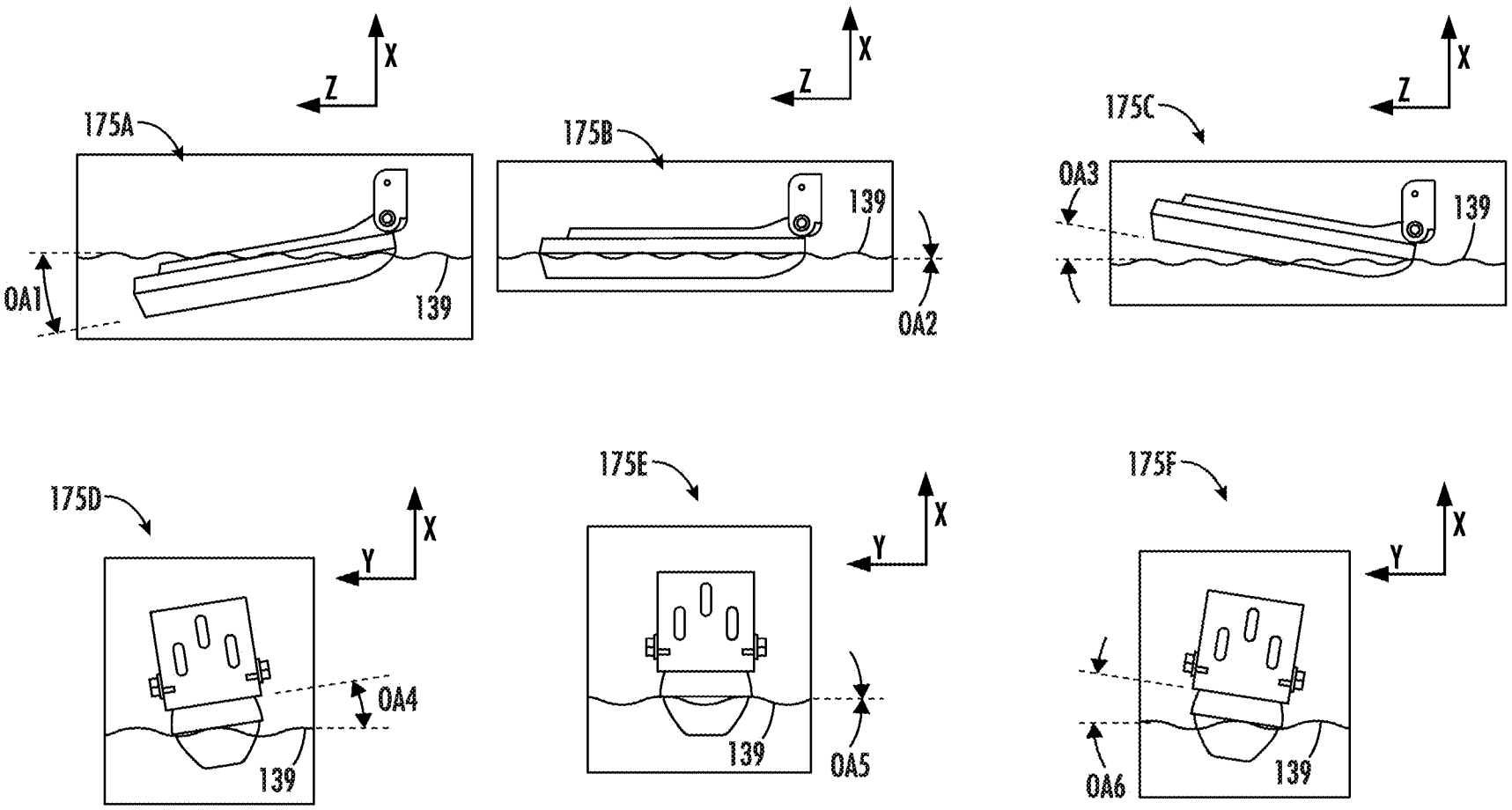
FIG. 1C is a schematic view illustrating a sonar transducer assembly oriented in different ways, in accordance with some embodiments discussed herein.

The orientation of sonar transducer assemblies may be adjusted so that the sonar transducer assemblies maintain optimal performance. FIG. 1C illustrates sonar transducer assemblies 175A-175F oriented in different ways. In each case, the surface 139 of the body of water defines a plane, and the relevant sonar transducer assembly defines an offset angle relative to that plane. The sonar transducer assembly 175A is rotated about the Y-axis, with the sonar transducer assembly 175A defining an offset angle OA1 relative to the surface 139. This offset angle OA1 is about 15 degrees. The sonar transducer assembly 175B has minimal rotation about the Y-axis, with the sonar transducer assembly 175B defining an offset angle OA2 relative to the surface 139. This offset angle OA2 may be about zero, and sonar transducer assembly 175B may serve as an example of an ideal orientation for sonar transducer assemblies, with the sonar transducer assembly 175B generally extending parallel to the surface 139. The sonar transducer assembly 175C is rotated about the Y-axis, with the sonar transducer assembly 175C defining an offset angle OA3 relative to the surface 139. This offset angle OA3 may be about 15 degrees.

The sonar transducer assemblies also should be oriented in an appropriate manner relative to other axes. For example, the sonar transducer assembly 175D is rotated about the Z-axis, with the sonar transducer assembly 175D defining an offset angle OA4 relative to the surface 139. This offset angle OA4 may be about 15 degrees. The sonar transducer assembly 175E has minimal rotation about the Z-axis, with the sonar transducer assembly 175E defining an offset angle OA5 relative to the surface 139. This offset angle OA5 may be about zero, and sonar transducer assembly 175E may serve as an example of an ideal orientation for sonar transducer assemblies, with the sonar transducer assembly 175E generally extending parallel to the surface 139. The sonar transducer assembly 175F is rotated about the Z-axis, with the sonar transducer assembly 175F defining an offset angle OA6 relative to the surface 139. This offset angle OA6 may be about 15 degrees.

In some embodiments, the offset angles may be optimized for when the watercraft is moving. For example, when the watercraft is moving at trolling speed, the watercraft may be oriented differently than when the watercraft is moving at a maximum speed or when the watercraft is not moving at all. Where the sonar transducer assemblies are oriented improperly, bubbles may be formed beneath the sonar transducer assemblies as the watercraft moves through the water, and this may cause a degradation in the sonar data obtained from the sonar transducer assemblies. For example, the sonar data may not be accurate all the way to the bottom of the body of water due to interference from these bubbles.

Figure 2:
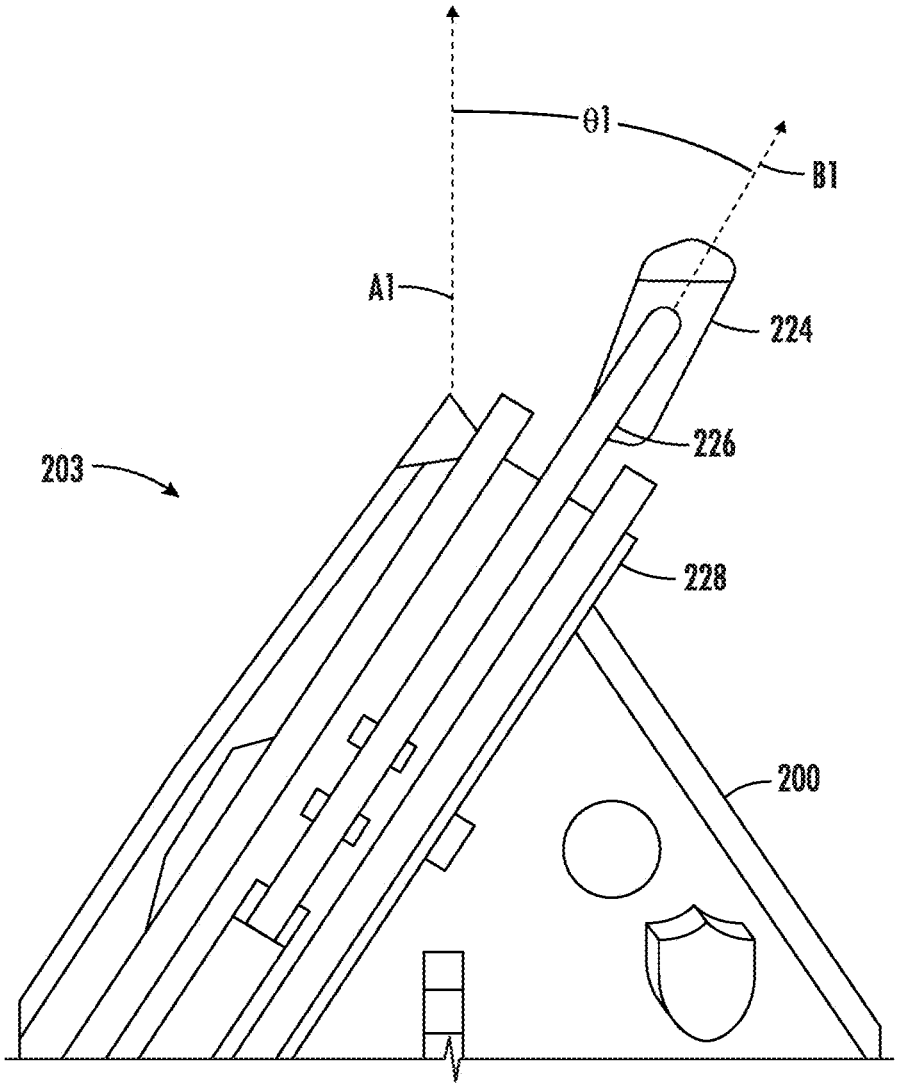
FIG. 2 is a top view illustrating an example trolling motor housing attached to a front of a watercraft, where there is an angular offset from the keel direction of the watercraft, in accordance with some embodiments discussed herein.

As noted previously, equipment may be installed with an offset, and users may not be able to accurately calibrate the equipment based on this offset. These calibration issues may cause the device to work sub-optimally. FIG. 2 illustrates an example of this, with a trolling motor housing 224 attached to a watercraft 200 with an angular offset θ1 from the keel direction of the watercraft 200. As illustrated in FIG. 2, the watercraft 200 may define a first direction A1, with this first direction being the keel direction of the watercraft 200. Additionally, the trolling motor housing 224 is attached to the bow 203 of the watercraft 200. The trolling motor housing 224 may be attached using the bracket 228 and an attachment member 226. The attachment member 226 of the trolling motor may define a second direction B1. In some embodiments, the trolling motor housing 224 may be pivotably attached to the attachment member 226, and the trolling motor housing 224 may be positioned such that there is an angular offset θ1 between the first direction A1 and the second direction B1. Where the system has not been calibrated to accurately identify the angular offset θ1, this may lead to significant issues when a user attempts to utilize the trolling motor oriented to generate thrust—the user may intend to generate thrust with the trolling motor in one direction but may unknowingly generate thrust in another substantially different direction. As a result of this miscalibration, a user attempting to navigate to a specific location may have increased difficulty. Rather than navigating directly to the desired location as intended by the user, the miscalibration may cause the user to inadvertently circle around the desired location, leading to significant frustration for the user and wasting the time of the user.

Figure 3A:
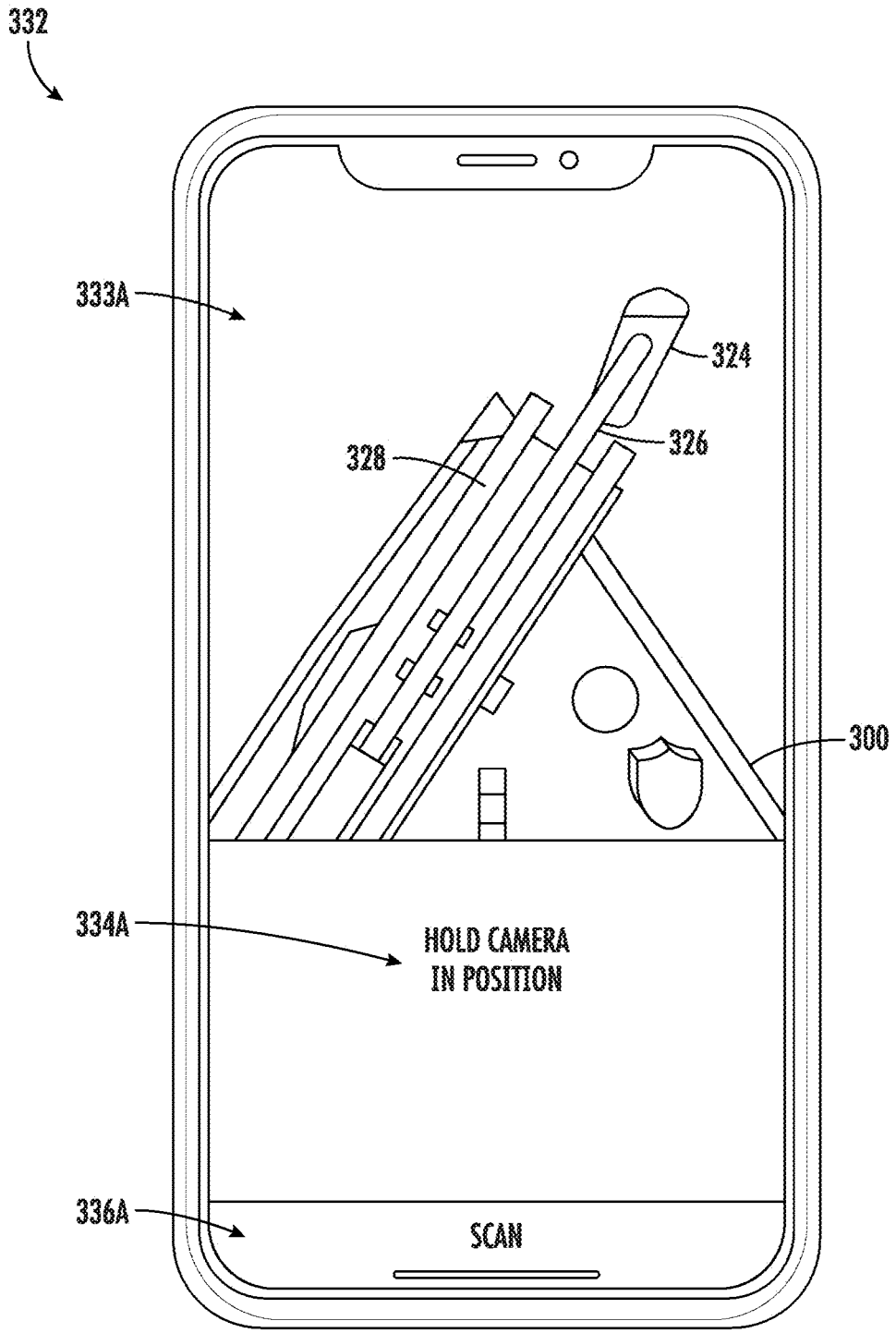
FIGS. 3A-3C are schematic views illustrating an example electronic device positioned above the trolling motor housing of FIG. 2, with the electronic device being used to determine an angular offset of the trolling motor housing relative to the watercraft, in accordance with some embodiments discussed herein.
Figure 3B:
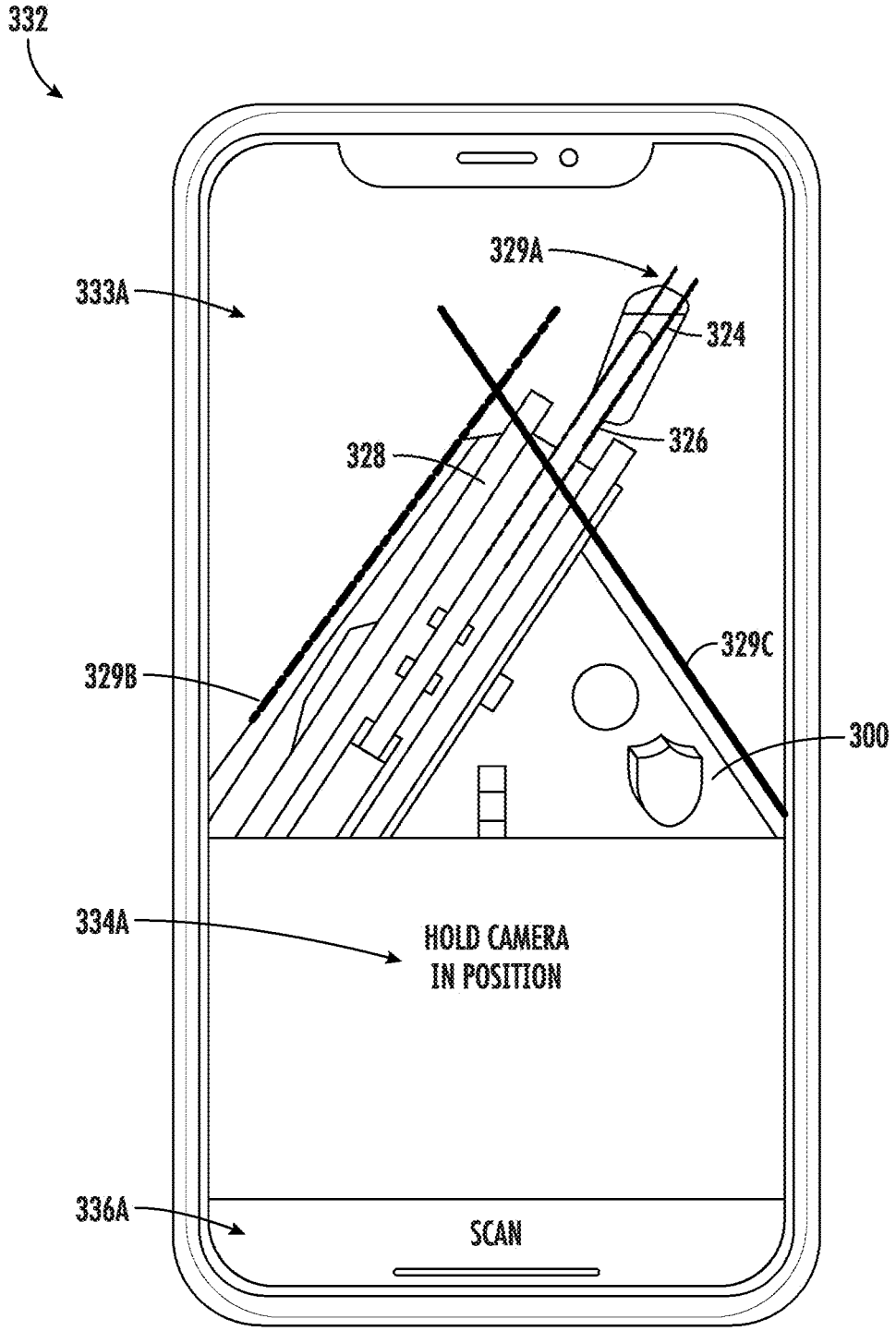
Figure 3C:
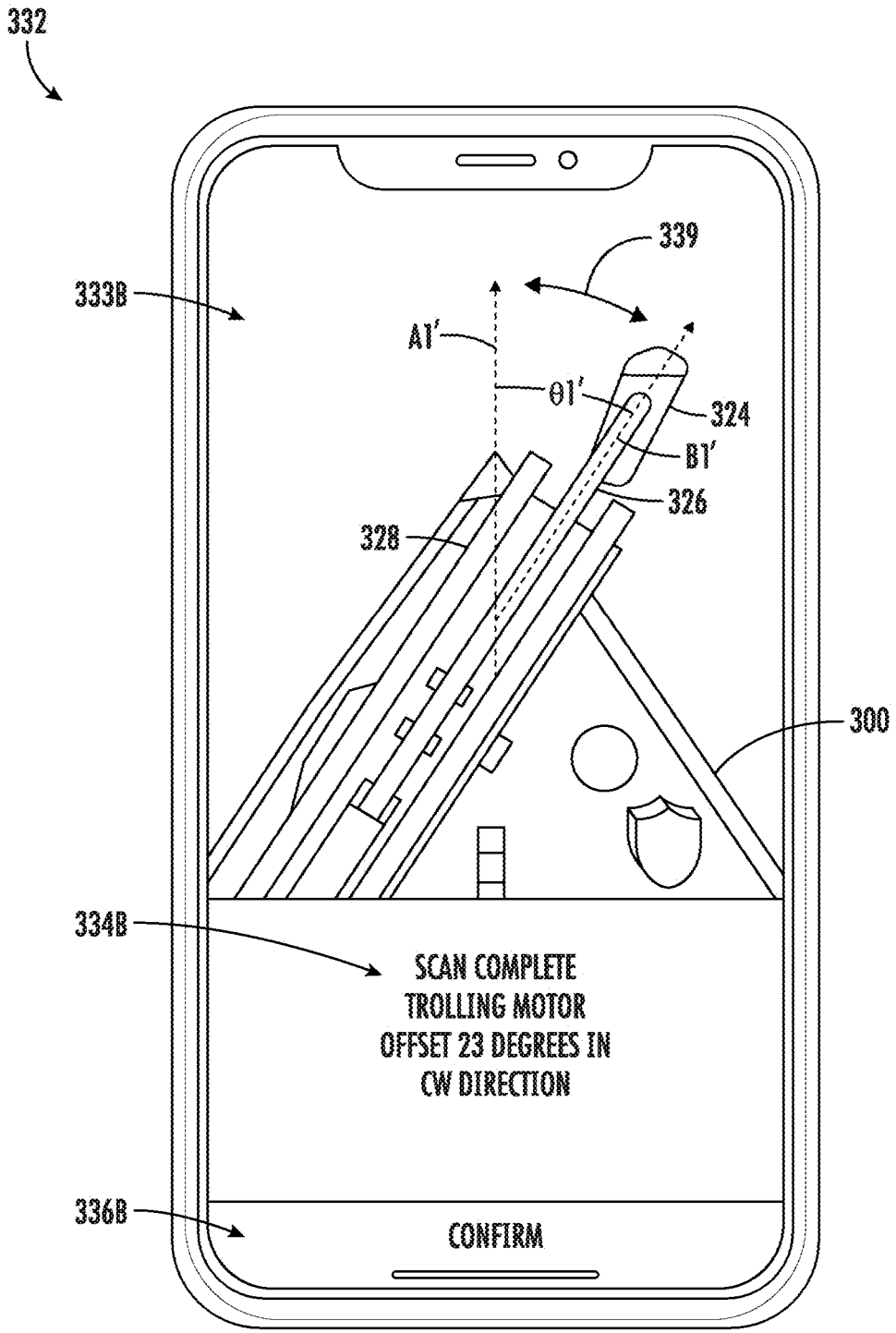

Electronic devices may be provided that are configured to calibrate the trolling motor housing 224 or other devices based on the amount of offset (e.g., angular offset as shown, but other types of offset are contemplated, such as linear offset). FIGS. 3A-3C illustrate an example electronic device 332 positioned above the trolling motor of FIG. 2, with the electronic device 332 being used to identify an angular offset θ1 of the attachment member 226 relative to the keel direction of the watercraft 200.

An electronic device 332 is illustrated, and the electronic device 332 may include a camera, one or more processors, and memory including computer program code. The electronic device 332 may also include a screen thereon that is configured to present an image in a top pane 333A. The computer program code may be configured to cause the processor(s) to receive images from the camera (e.g., live or taken images) and to determine a first direction A1 associated with the watercraft as indicated by the representation of the first direction A1' in FIG. 3C. The representation of the first direction A1' extends in a direction parallel to the keel 107 (see FIG. 1A) of the watercraft 200. The computer program code may be configured to cause the processor(s) to determine a second direction B1 associated with the attachment member 226 of the trolling motor, and this is represented in FIG. 3C by the representation of the second direction B1'. The second direction B1 is a forward direction extending outwardly from the watercraft.

The determination of the first direction A1 and/or the second direction B1 associated with the watercraft may be performed using one or more images taken at the camera. These images may be taken (e.g., captured) images or live images. The determination may be accomplished through image processing techniques such as a Hough transform. This determination of these directions A1, B1 may be performed using data regarding points on the watercraft that are positioned on a bow of the watercraft. However, data used for Hough transforms may be different in other embodiments where devices are being positioned at different locations on a watercraft. For example, where a sonar transducer assembly is being mounted at a transom of a watercraft, on a motor of the watercraft, or at another location on the watercraft, the Hough transform may utilize data regarding points positioned at the transom of the watercraft or positioned at other points on the watercraft. Points at edges of features may be the focus of image processing techniques, but other points may be considered as well in some embodiments.

The first direction A1 and/or the second direction B1 may be determined by analyzing data for points at edges of features in the images. For example, as illustrated in FIG. 3B, lines may be formed at edges of critical features, with these lines connecting various points at the edges. For example, the first lines 329A are positioned at edges of the representation of the attachment member 326, the second line 329B is positioned at edges of the representation of the watercraft at a first side of the bow, and the third line 329C is positioned at edges of the representation of the watercraft at a second side of the bow. While only a limited number of lines 329A, 329B, 329C are illustrated in FIG. 3B, it should be understood that a greater or fewer number of lines may be used during image processing to determine the directions of relevant components. For example, in other embodiments, significantly more lines may be identified and analyzed during image processing.

Based on the determined first direction A1 and the determined second direction B1, the computer program code may be configured to cause the processor(s) to determine an angular offset θ1 between the first direction A1 and the second direction B1. A representation of this angular offset θ1' is represented in FIG. 3C. The computer program code may also be configured to cause the processor(s) to cause the indication of the angular offset θ1 to be stored in memory, and this amount of angular offset may be presented to the user on a display and/or this amount of angular offset may be used by other systems. The angular offset θ1 may be used with one or more functions associated with the device.

The screen of the electronic device 332 includes a top pane 333A, a bottom pane 334A, and a selection button 336A. In FIG. 3A, the top pane 333A includes a live image of the watercraft and components thereon. Additionally, the bottom pane 334A provides instructions for the user so that the user may effectively determine the angular offset, and the selection button 336A may be selected to allow the user to begin scanning the watercraft 200, the trolling motor, and the other components. In FIG. 3C, the screen of the electronic device 332 includes a top pane 333B, a bottom pane 334B, and a selection button 336B. The bottom pane 334B includes a representation of the angular offset, with this representation being provided in the form of text indicating the amount of angular offset. However, the representation of the angular offset may be provided in other ways. For example, a representation of the angular offset may be provided on the image of the top pane 333B in the form of the indicator 339, and the image presented in the top pane 333B may be a live image that shows the representation of the trolling motor housing 324, the representation of the attachment member 326, a representation of the bracket 328, and a representation of the watercraft 300. Thus, the top pane 333B may present an augmented reality image that indicates the amount of the angular offset. The image may also include representations of the first direction A1, the second direction B1, and the angular offset θ1. In some embodiments, the augmented reality image may emphasize the relevant material within the image. For example, the electronic device may present the representation of the attachment member 326, the representation of the watercraft 300, and the electronic device may hide other elements on the live image. Alternatively, the electronic device may present the representation of the attachment member 326 and the representation of the watercraft 300 with shading or an outline for emphasis, and the electronic device may present other elements on the live image without any such emphasis.

The electronic device 332 may be positioned proximate to the trolling motor housing 224 of FIG. 2 in order to obtain an image of the trolling motor housing 224. For example, in FIG. 3A, the electronic device 332 is positioned above the trolling motor housing 224 so that an image is created using a camera 332A of the electronic device 332. However, in other embodiments, the electronic device 332 may be positioned at other locations relative to the trolling motor housing 224—for example, the electronic device 332 may be positioned on a side of a trolling motor housing 224 or at some other position relative to the trolling motor housing 224 so that an image may be taken.

Figure 3D:
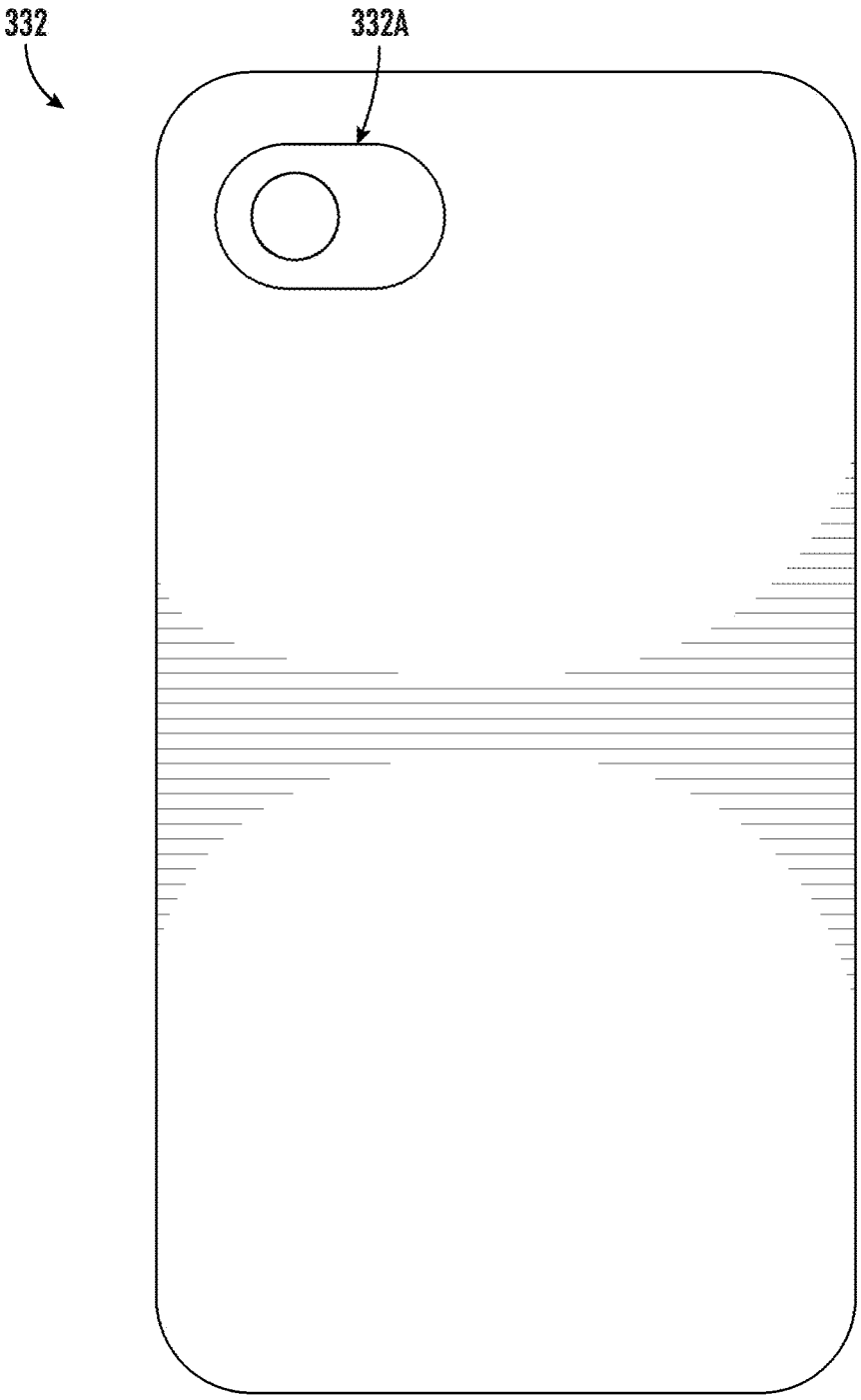
FIG. 3D is a schematic view illustrating an example camera on the electronic device of FIGS. 3A-3C, in accordance with some embodiments discussed herein.

The electronic device may include a camera in some embodiments. For example, FIG. 3D illustrates an example camera 332A on the electronic device 332 of FIGS. 3A-3C. The electronic device 332 is provided in the form of smart phone, but cameras may also be provided on other electronic devices as well.

Figure 4A:
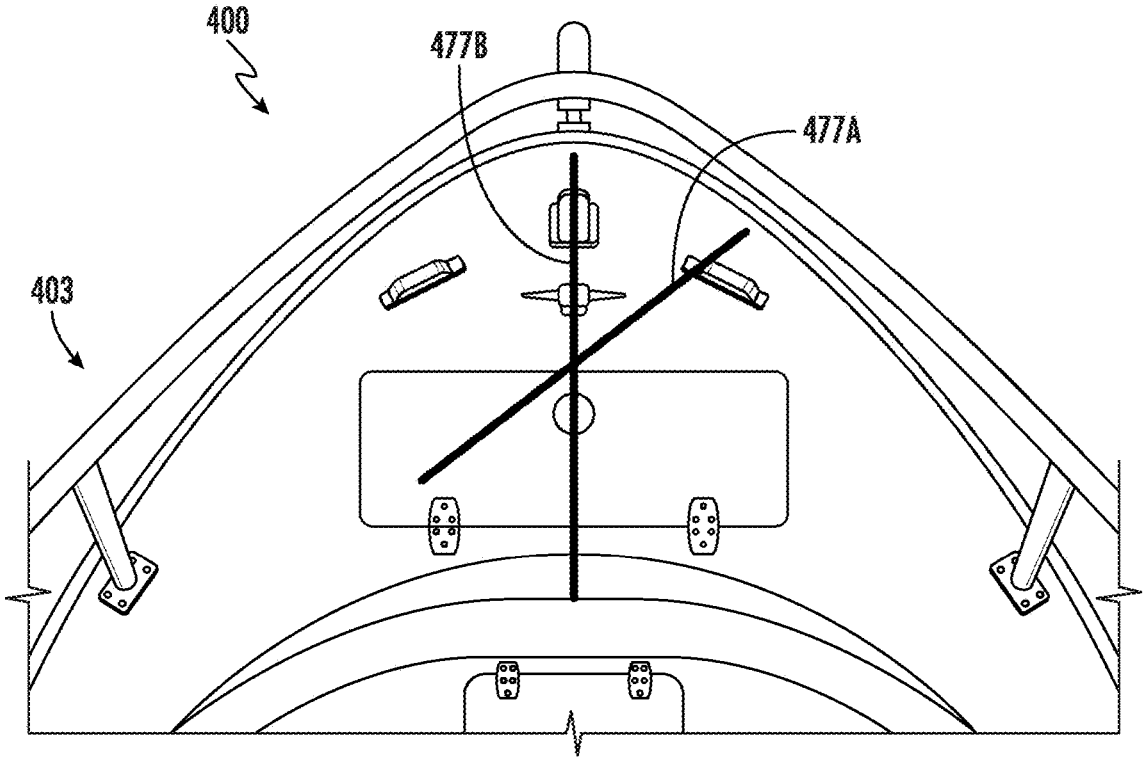
FIG. 4A is a top view illustrating example lines for a device being installed and lines for a keel of a watercraft, with lines positioned on a bow of the watercraft to assist with alignment, in accordance with some embodiments discussed herein.
Figure 4B:
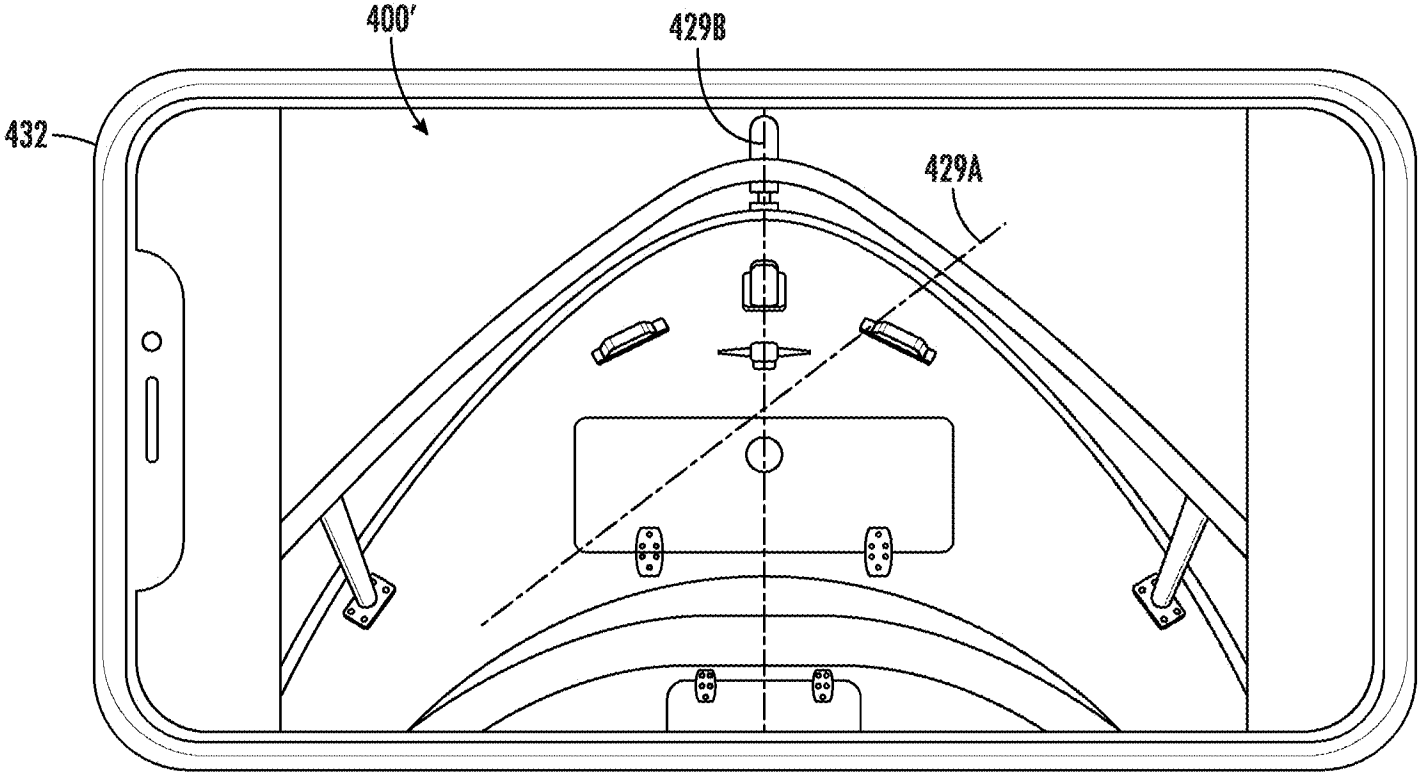
FIG. 4B is a schematic view illustrating an example electronic device being used to determine an angular offset based on the reference lines of FIG. 4A, in accordance with some embodiments discussed herein.

In some embodiments, a user may use tape or another similar material to assist with image processing. For example, in FIG. 4A, tape is positioned on a bow 403 of the watercraft 400 to assist with alignment, with the tape providing example lines associated with a device being installed and a keel of the watercraft. A first tape segment 477A is positioned at a first angle, and this first tape segment 477A may be indicative of the orientation of the device being installed (e.g., a trolling motor, a sonar transducer, another motor, a sensor, etc.). The second tape segment 477B is positioned at a second angle, and this second tape segment 477B may be indicative of a certain direction on a watercraft. In FIG. 4A, the second tape segment 477B is indicative of the keel direction of the watercraft. Once tape segments 477A, 477B are in position, an electronic device 432 may then be utilized in a manner similar to how the electronic device 332 of FIGS. 3A-3C is used to determine the angular offset (if any). As illustrated in FIG. 4B, the electronic device 432 may identify or extract a first line 429A associated with the first tape segment 477A, and the electronic device 432 may identify or extract a second line 429B associated with the second tape segment 477B. Once these lines 429A, 429B are obtained, the lines 429A, 429B may be used to determine the relevant directions and the amount of offset. In some embodiments, lines 429A, 429B that are generated are presented on an image in the display of the electronic device 432 so that the lines 429A, 429B are visible on the representation of the watercraft 400'. However, in other embodiments, the lines 429A, 429B may not be presented to the user and may instead be processed in the background. Also, the lines associated with a device and a keel of the watercraft may be represented using techniques other than tape. For example, temporary or permanent markings may be used, or other objects may be used to represent the lines.

Figure 5:
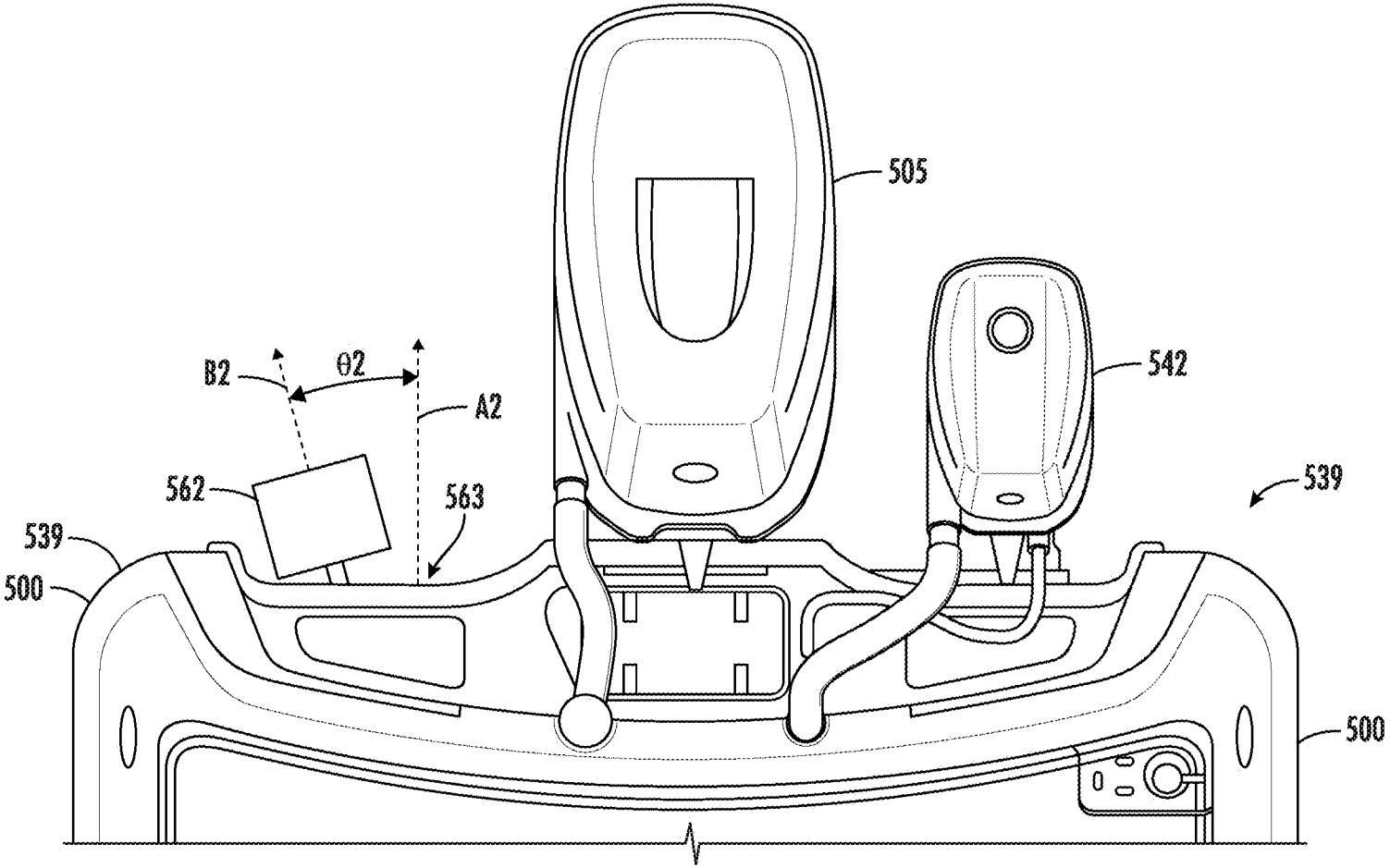
FIG. 5 is a schematic, top view illustrating an example sonar transducer assembly attached to a watercraft with an angular offset from a rearward direction of the watercraft, in accordance with some embodiments discussed herein.

The approaches described herein may also be used to assist in positioning other devices and to assist in positioning devices at other locations on a watercraft. FIG. 5 is a schematic, top view illustrating an example sonar transducer assembly 562 attached to a watercraft 500 with an angular offset θ2 from a rearward direction of the watercraft 500. The watercraft 500 includes a primary motor 505 and a kicker motor 542 attached to the watercraft 500 as well as the sonar transducer assembly 562. The sonar transducer assembly 562 is pivotably attached to the transom 539 of the watercraft 500, with an arm attaching the sonar transducer assembly 562 to a rear surface 563 at the transom 539.

The watercraft 500 may define a first direction A2, and this first direction A2 is a rearward direction of the watercraft 500 in FIG. 5. The sonar transducer assembly 562 may be configured to cause the emission of sonar signals in a second direction B2. In the example illustrated in FIG. 5, the sonar transducer assembly 562 of FIG. 5 is mounted with an angular offset θ2 relative to the rearward direction of the watercraft.

Figure 6A:
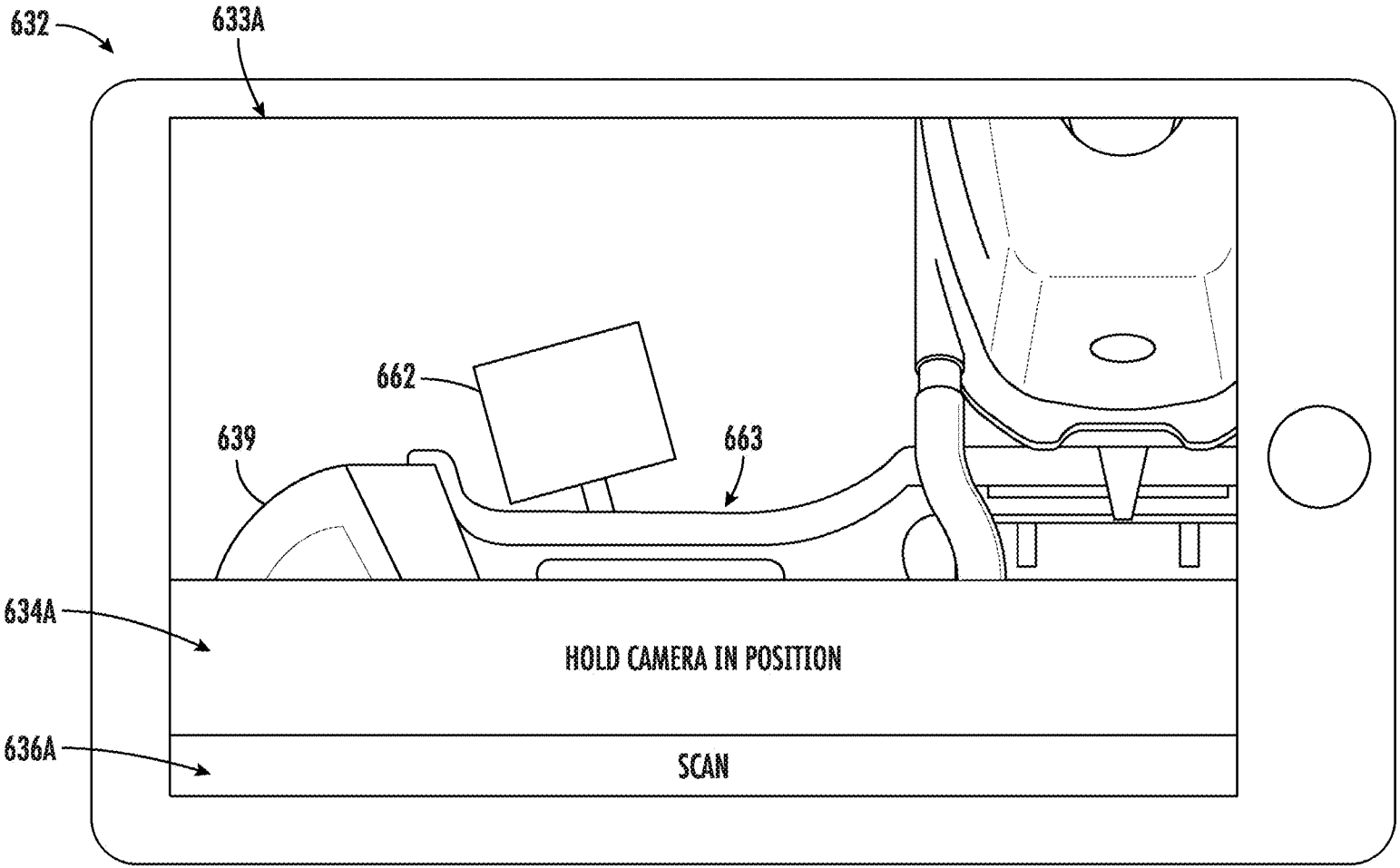
FIGS. 6A-6B are schematic views illustrating an example electronic device positioned above the sonar transducer assembly of FIG. 5, with the electronic device being used to determine an angular offset of the sonar transducer assembly relative to the watercraft, in accordance with some embodiments discussed herein.
Figure 6B:
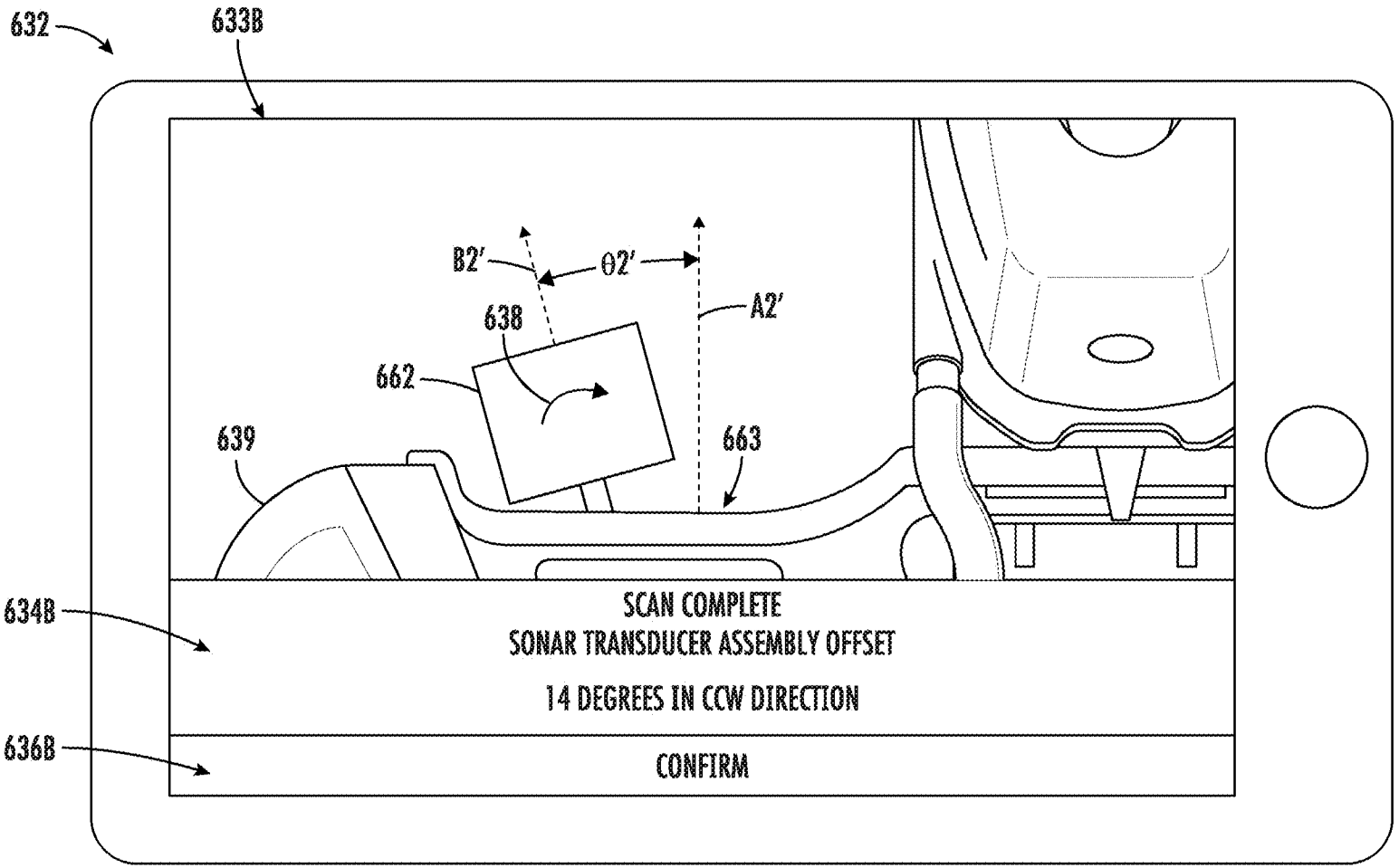

Electronic devices of various embodiments described herein may be configured to determine the offset for the sonar transducer assembly or other devices. FIGS. 6A-6B illustrate an example electronic device 632 positioned above the sonar transducer assembly 562 of FIG. 5, with the electronic device 632 being used to determine an angular offset θ2 of the sonar transducer assembly 532 relative to the watercraft 500.

An electronic device 632 is illustrated, and the electronic device 632 may include a camera, one or more processors, and memory including computer program code. The electronic device 632 may also include a screen thereon that is configured to present an image in a top pane 633A. The computer program code may be configured to cause the processor(s) to determine a first direction A2 associated with the watercraft as indicated by the representation of the first direction A2' in FIG. 6B. The representation of the first direction A2' extends in a direction normal to the representation of the rear surface 663, which is positioned at the representation of the transom 639. The computer program code may be configured to cause the processor(s) to determine a second direction B2 associated with the sonar transducer assembly 562, and this is represented in FIG. 6B by the representation of the second direction B2'. The second direction is a pointing direction that extends outwardly from the watercraft. Based on the determined first direction A2 and the determined second direction B2, the computer program code may be configured to cause the processor(s) to determine an angular offset θ2 between the first direction A2 and the second direction B2. A representation of this angular offset θ2' is represented in FIG. 6B. The computer program code may also be configured to cause the processor(s) to cause the indication of the angular offset θ2 to be stored in memory, and this amount of angular offset may be presented to the user on a display or this amount of angular offset may be used by other systems. The angular offset θ2 may be used with one or more functions associated with the device.

The screen of the electronic device 632 includes a bottom pane 634A and a selection button 636A. In FIG. 6A, the bottom pane 634A provides instructions for the user so that the user may effectively determine the angular offset, and the selection button 636A may be selected to allow the user to begin scanning the watercraft 500, the sonar transducer assembly 562, and the other components. In FIG. 6B, the screen of the electronic device 632 includes a bottom pane 634B and a selection button 636B. The bottom pane 634B includes a representation of the angular offset, with this representation being provided in the form of text indicating the amount of angular offset. However, the representation of the angular offset may be provided in other ways. For example, a representation of the angular offset may be provided on the image in the top pane 633B in the form of the indicator 638, which may be a live image that shows the representation of the sonar transducer assembly 662, providing an augmented reality image that assist in indicating corrections necessary to reduce the angular offset if so desired.

While the electronic device 332 of FIGS. 3A-3D is a smart phone and while the electronic device 632 of FIGS. 6A-6B is a tablet, other types of electronic devices may be utilized in place of these example electronic devices. For example, electronic devices may be provided in the form of a laptop, a smart watch, smart glasses, a cell phone, or some other device.

While FIGS. 6A-6B illustrate the electronic device 632 being positioned above the sonar transducer assembly 662, electronic devices may be positioned at other locations relative to a sonar transducer assembly. For example, looking at FIG. 1B, the sonar transducer assembly 175 is illustrated attached at the transom 106 of the watercraft 100. An electronic device may be positioned to the side of the sonar transducer assembly 662 to determine the position of the sonar transducer assembly 662 within a body of water or the orientation of the sonar transducer assembly 662. Where the electronic device is positioned at the side of a sonar transducer assembly or at another position relative to the sonar transducer assembly, the electronic device may still generally operate in the same manner as other electronic devices described herein. While the sonar transducer assembly 175 is illustrated as being under water, an electronic device may be used to determine the position of the sonar transducer assembly 662 when the watercraft is not in the water.

In some embodiments, the electronic device 632 may be positioned relative to the sonar transducer assembly to identify an offset in the position or orientation of the sonar transducer assembly, and the orientation or position of sonar transducer assemblies may be adjusted so that the sonar transducer assemblies maintain optimal performance. Looking at the sonar transducer assemblies 175A-175C in FIG. 1C, an electronic device 632 may be positioned relative to each of the sonar transducer assemblies 175A-175C so that the electronic device 632 may capture an image of the sonar transducer assemblies 175A-175C. For example, the electronic device 632 may be positioned to the side of the sonar transducer assemblies 175A-175C when the image is captured. Once the image is captured, the image may be utilized to determine the offset angle for the sonar transducer assemblies 175A-175C. For example, the offset angle θ1 may be identified for the sonar transducer assembly 175A, the offset angle θ2 may be identified for the sonar transducer assembly 175B, and the offset angle θ3 may be identified for the sonar transducer assembly 175C. In some embodiments, once the offset angle is determined, corrections may be suggested or corrections may be automatically made at the sonar transducer assemblies 175A-175C. Once corrections are made, the offset angle of the sonar transducer assemblies 175A-175C may be similar to the offset angle θ2 for the sonar transducer assembly 175B in some embodiments.

Turning now to the sonar transducer assemblies 175D-175F in FIG. 1C, an electronic device 632 may be positioned relative to each of the sonar transducer assemblies 175D-175F so that the electronic device 632 may capture an image of the sonar transducer assemblies 175D-175F. For example, the electronic device 632 may be positioned to the front or the rear of the sonar transducer assemblies 175D-175F when the image is captured. Once the image is captured, the image may be utilized to determine the offset angle for the sonar transducer assemblies 175D-175F. For example, the offset angle θ4 may be identified for the sonar transducer assembly 175D, the offset angle θ5 may be identified for the sonar transducer assembly 175E, and the offset angle θ6 may be identified for the sonar transducer assembly 175F. In some embodiments, once the offset angle is determined, corrections may be suggested or corrections may be automatically made at the sonar transducer assemblies 175D-175F. Once corrections are made, the offset angle of the sonar transducer assemblies 175D-175F may be similar to the offset angle θ5 for the sonar transducer assembly 175E in some embodiments.

Height mounted at the rear of the boat and angle up/down. The transducer must be in the water, but not too much. And pointed in the right direction for the correct angle of view. See diagram below.

Figure 7:
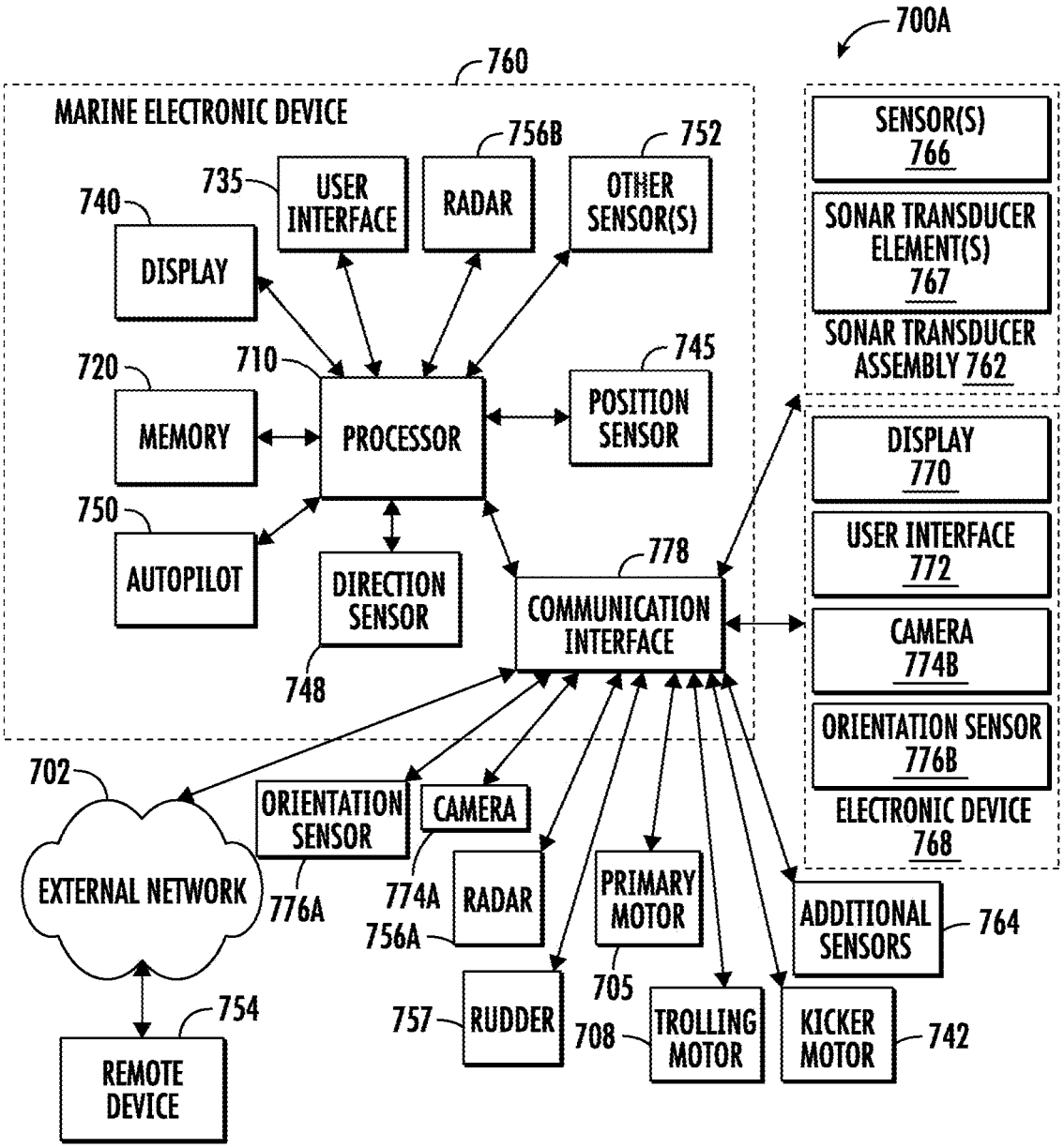
FIG. 7 is a block diagram illustrating an example system with various electronic devices, marine devices, and secondary devices shown, in accordance with some embodiments discussed herein.

The watercraft may have systems thereon including various electrical components, and FIG. 7 is a block diagram illustrating electrical components that may be provided in one example system 700A. The system 700A may comprise numerous marine devices. As shown in FIG. 7, a sonar transducer assembly 762, a radar 756A, a rudder 757, a primary motor 705, a trolling motor 708, and additional sensors/devices 764 may be provided as marine devices, but other marine devices may also be provided. One or more marine devices may be implemented on the marine electronic device 760 as well. For example, a position sensor 745, a direction sensor 748, an autopilot 750, and other sensors/devices 752 may be provided within the marine electronic device 760. These marine devices can be integrated within the marine electronic device 760, integrated on a watercraft at another location and connected to the marine electronic device 760, and/or the marine devices may be implemented at a remote device 754 in some embodiments. The system 700A may include any number of different systems, modules, or components, each of which may comprise any device or means embodied in either hardware, software, or a combination of hardware and software configured to perform one or more corresponding functions described herein.

The marine electronic device 760 may include at least one processor 710, a memory 720, a communications interface 778, a user interface 735, a display 740, autopilot 750, and one or more sensors (e.g. position sensor 745, direction sensor 748, other sensors/devices 752). One or more of the components of the marine electronic device 760 may be located within a housing or could be separated into multiple different housings (e.g., be remotely located).

The processor(s) 710 may be any means configured to execute various programmed operations or instructions stored in a memory device (e.g., memory 720) such as a device or circuitry operating in accordance with software or otherwise embodied in hardware or a combination of hardware and software (e.g. a processor operating under software control or the processor embodied as an application specific integrated circuit (ASIC) or field programmable gate array (FPGA) specifically configured to perform the operations described herein, or a combination thereof) thereby configuring the device or circuitry to perform the corresponding functions of the processor(s) 710 as described herein.

In an example embodiment, the memory 720 may include one or more non-transitory storage or memory devices such as, for example, volatile and/or non-volatile memory that may be either fixed or removable. The memory 720 may be configured to store instructions, computer program code, radar data, and additional data such as sonar data, chart data, location/position data in a non-transitory computer readable medium for use, such as by the processor(s) 710 for enabling the marine electronic device 760 to carry out various functions in accordance with example embodiments of the present invention. For example, the memory 720 could be configured to buffer input data for processing by the processor(s) 710. Additionally or alternatively, the memory 720 could be configured to store instructions for execution by the processor(s) 710. The memory 720 may include computer program code that is configured to, when executed, cause the processor(s) 710 to perform various methods described herein. The memory 720 may serve as a non-transitory computer readable medium having stored thereon software instructions that, when executed by a processor, cause methods described herein to be performed.

The communications interface 778 may be configured to enable communication to external systems (e.g. an external network 702). In this manner, the marine electronic device 760 may retrieve stored data from a remote device 754 via the external network 702 in addition to or as an alternative to the onboard memory 720. Additionally or alternatively, the marine electronic device 760 may transmit or receive data, such as radar signal data, radar return data, radar image data, path data or the like to or from a sonar transducer assembly 762. In some embodiments, the marine electronic device 760 may also be configured to communicate with other devices or systems (such as through the external network 702 or through other communication networks, such as described herein). For example, the marine electronic device 760 may communicate with a propulsion system of the watercraft 100 (e.g., for autopilot control); a remote device (e.g., a user's mobile device, a handheld remote, etc.); or another system.

The communications interface 778 of the marine electronic device 760 may also include one or more communications modules configured to communicate with one another in any of a number of different manners including, for example, via a network. In this regard, the communications interface 778 may include any of a number of different communication backbones or frameworks including, for example, Ethernet, the NMEA 2000 framework, GPS, cellular, Wi-Fi, or other suitable networks. The network may also support other data sources, including GPS, autopilot, engine data, compass, radar, etc. In this regard, numerous other peripheral devices (including other marine electronic devices or transducer assemblies) may be included in the system 700A.

The position sensor 745 may be configured to determine the current position and/or location of the marine electronic device 760 (and/or the watercraft 100). For example, the position sensor 745 may comprise a GPS, bottom contour, inertial navigation system, such as machined electromagnetic sensor (MEMS), a ring laser gyroscope, or other location detection system. Alternatively or in addition to determining the location of the marine electronic device 760 or the watercraft 100, the position sensor 745 may also be configured to determine the position and/or orientation of an object outside of the watercraft 100.

The display 740 (e.g. one or more screens) may be configured to present images and may include or otherwise be in communication with a user interface 735 configured to receive input from a user. The display 740 may be, for example, a conventional LCD (liquid crystal display), a touch screen display, mobile device, or any other suitable display known in the art upon which images may be displayed.

In some embodiments, the display 740 may present one or more sets of data (or images generated from the one or more sets of data). Such data includes chart data, radar data, sonar data, weather data, location data, position data, orientation data, sonar data, or any other type of information relevant to the watercraft. Radar data may be received from radar 756A located outside of a marine electronic device 760, radar 756B located in a marine electronic device 760, or from radar devices positioned at other locations, such as remote from the watercraft. Additional data may be received from marine devices such as a sonar transducer assembly 762, a primary motor 705 or an associated sensor, a trolling motor 708 or an associated sensor, a kicker motor 742 or an associated sensor, an autopilot 750, a rudder 757 or an associated sensor, a position sensor 745, a direction sensor 748, other sensors/devices 752, a remote device 754, onboard memory 720 (e.g., stored chart data, historical data, etc.), or other devices.

The user interface 735 may include, for example, a keyboard, keypad, function keys, buttons, a mouse, a scrolling device, input/output ports, a touch screen, or any other mechanism by which a user may interface with the system.

Although the display 740 of FIG. 7 is shown as being directly connected to the processor(s) 710 and within the marine electronic device 760, the display 740 may alternatively be remote from the processor(s) 710 and/or marine electronic device 760. Likewise, in some embodiments, the position sensor 745 and/or user interface 735 may be remote from the marine electronic device 760.

The marine electronic device 760 may include one or more other sensors/devices 752, such as configured to measure or sense various other conditions. The other sensors/devices 752 may include, for example, an air temperature sensor, a water temperature sensor, a current sensor, a light sensor, a wind sensor, a speed sensor, or the like.

A sonar transducer assembly 762 is also provided in the system 700A. The sonar transducer assembly 762 illustrated in FIG. 7 may include one or more sonar transducer elements 767, such as may be arranged to operate alone or in one or more transducer arrays. In some embodiments, additional separate sonar transducer elements (arranged to operate alone, in an array, or otherwise) may be included. As indicated herein, the sonar transducer assembly 762 may also include a sonar signal processor or other processor (although not shown) configured to perform various sonar processing. In some embodiments, the processor (e.g., processor(s) 710 in the marine electronic device 760, a controller (or processor portion) in the sonar transducer assembly 762, or a remote controller—or combinations thereof) may be configured to filter sonar return data and/or selectively control sonar transducer element(s) 767. For example, various processing devices (e.g., a multiplexer, a spectrum analyzer, A-to-D converter, etc.) may be utilized in controlling or filtering sonar return data and/or transmission of sonar signals from the sonar transducer element(s) 767. The processor(s) 710 may also be configured to filter data regarding certain objects out of map data.

The sonar transducer assembly 762 may also include one or more other systems, such as various sensor(s) 766. For example, the sonar transducer assembly 762 may include an orientation sensor, such as gyroscope or other orientation sensor (e.g., accelerometer, MEMS, etc.) that may be configured to determine the relative orientation of the sonar transducer assembly 762 and/or the one or more sonar transducer element(s) 767—such as with respect to a keel direction of the watercraft. In some embodiments, additionally or alternatively, other types of sensor(s) are contemplated, such as, for example, a water temperature sensor, a current sensor, a light sensor, a wind sensor, a speed sensor, or the like. While only one sonar transducer assembly 762 is illustrated in FIG. 7, additional sonar transducer assemblies may be provided in other embodiments.

An electronic device 768 is also included. The electronic device 768 may be a phone such as a smart phone, a cell phone, smart glasses, a tablet, a computer, a headset, or another electronic device. The electronic device 768 comprises a display 770, with the display 770 having a screen. In some embodiments, the display 770 may be a touch display that is configured to receive input from a user by detecting the user touching the display 770 with a finger. A user interface 772 is also provided in the electronic device 768, and the user interface 772 may include one or more input buttons, a speaker, a microphone, a keypad, and other mechanisms to enable the user to input commands. The electronic device 768 may also comprise a camera 774B to obtain one or more images, which may be live images. The electronic device 768 may also comprise an orientation sensor 776B. The orientation sensor 776B may be configured to determine the orientation at the camera 774B.

Alternatively, a camera 774A and an associated orientation sensor 776A may be positioned at another location on the watercraft, with the orientation sensor 776A being configured to determine the orientation at the camera 774A.

The components presented in FIG. 7 may be rearranged to alter the connections between components. For example, in some embodiments, a marine device outside of the marine electronic device 760, such as the radar 756A, may be directly connected to the processor(s) 710 rather than being connected to the communications interface 778. Additionally, sensors and devices implemented within the marine electronic device 760 may be directly connected to the communications interface 778 in some embodiments rather than being directly connected to the processor(s) 710.

Figure 8:
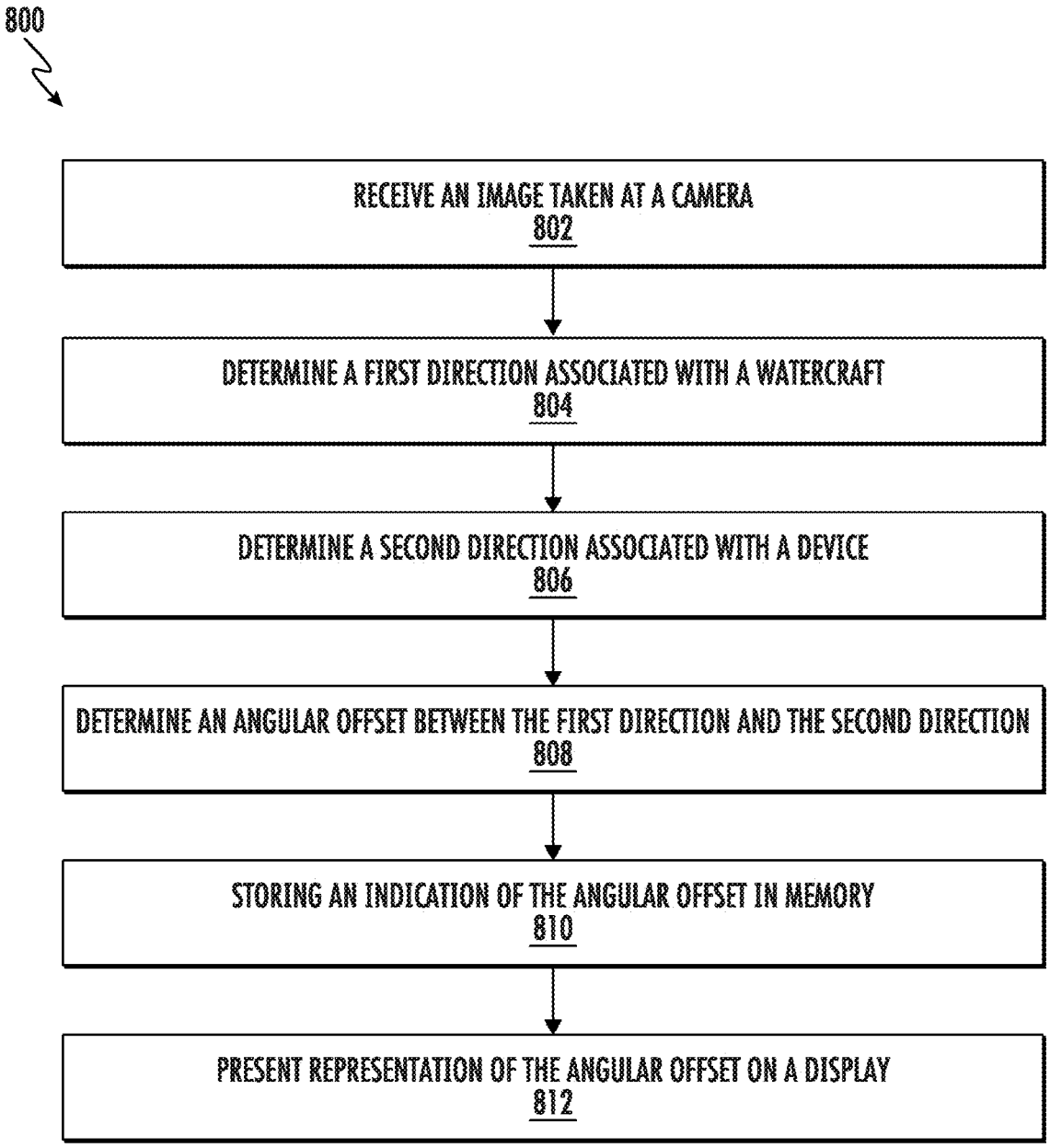
FIG. 8 is a flow chart illustrating an example method for determining an angular offset for a device attached to a watercraft, in accordance with some embodiments discussed herein.

FIG. 8 illustrates an example method 800 for determining an angular offset for a device attached to a watercraft. At operation 802, an image taken at a camera is received. This image may be taken at various positions relative to the device. For example, the image may be taken from a position above the device, from a position at a side of the device, or at another position.

At operation 804, a first direction associated with a watercraft is determined. This first direction may be dependent on the type of device being installed and the location where the device is being installed. For example, where a device being installed is a trolling motor having a trolling motor housing that is being installed at a bow of a watercraft, the first direction may be associated with the direction that the keel of the watercraft extends in.

At operation 806, a second direction associated with a device is determined. The device may be a sonar transducer assembly, a trolling motor housing, a kicker motor, a primary motor, a radar device, etc. However, several other devices may be utilized in method 800 to accomplish effective alignment during installation.

In some embodiments, the image received at operation 802 may be used to assist in determining the first direction and the second direction at operations 804 and 806. In some embodiments, the image may be the only material used to determine the second direction, but other material may be utilized to assist in the determination in other embodiments. Image processing techniques such as a Hough transform may be used to assist in determining the first direction and/or the second direction, and these image processing techniques may rely on data obtained for various points on the watercraft (e.g., at the bow of the watercraft, at the transom of the watercraft, etc.). Points at edges of features may be the focus of image processing techniques, but other points may be considered as well in some embodiments. However, in some embodiments, operation 802 may be omitted and the first direction and the second direction may be determined in other ways (e.g., based on inputs received from users on a display) without use of image processing techniques. At operation 808, an angular offset between the first direction and the second direction is determined.

At operation 810, an indication of the angular offset may be stored in memory. This indication may be a numerical value in some embodiments, but the indication may be provided in other forms (e.g., an image, a qualitative classification for the angular offset as high, medium, or low, etc.). As detailed herein, such angular offset stored in the memory may be used by various systems, such as the marine electronic device 760, trolling motor 708, or other devices with various functionality, such as for orientation sensing, navigation, among other functionality.

At operation 812, a representation of the angular offset is presented on a display. The representation of the angular offset may be presented on the display by presenting text to the user indicating the amount of angular offset. However, the representation of the angular offset may be presented on the display by presenting one or more indicators on a live image showing the device, with the indicator(s) indicating the amount of angular offset.

Figure 9:
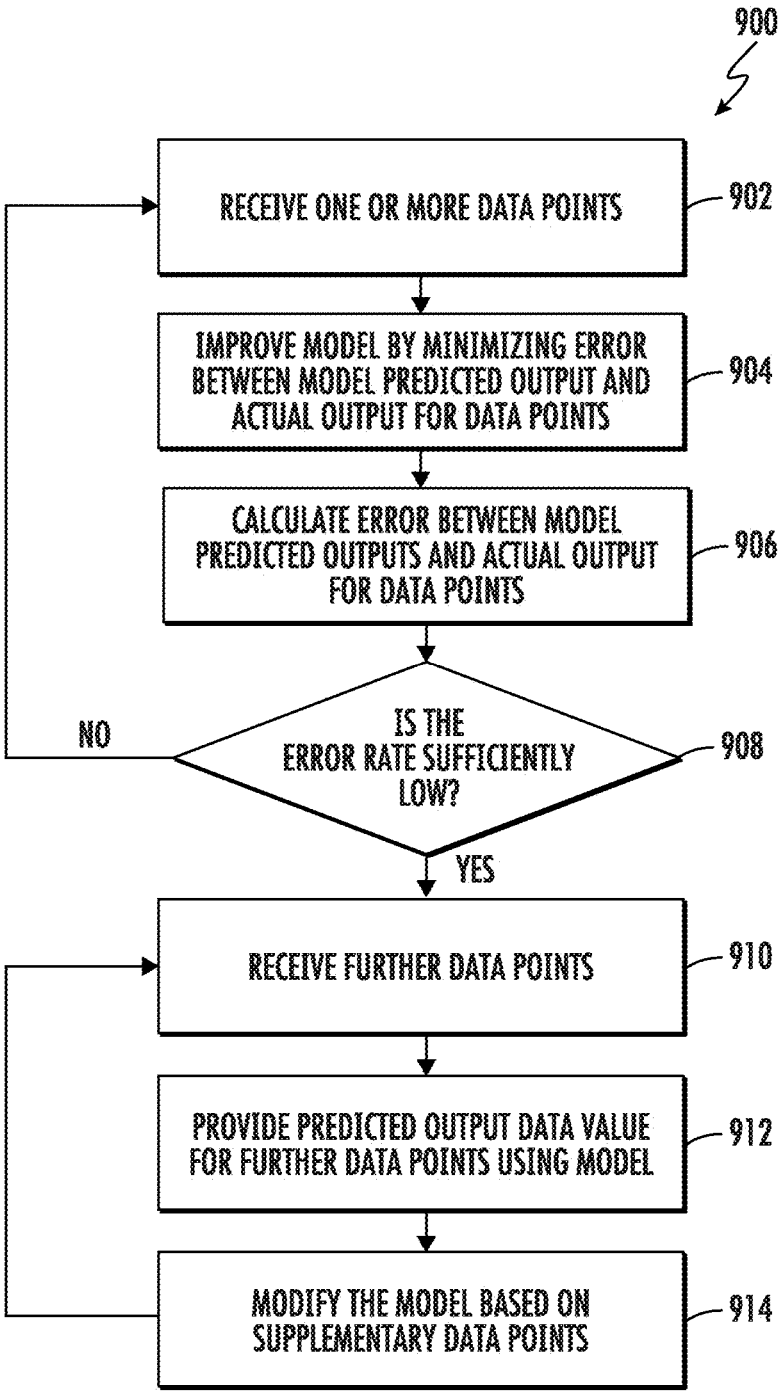
FIG. 9 is a flow chart illustrating an example method for performing machine learning in image processing, in accordance with some embodiments discussed herein.

FIG. 9 illustrates a flowchart of an example method 900 of machine learning, such as may be utilized with artificial intelligence for various embodiments of the present invention. As described herein in various embodiments, at least one processor or another suitable device may be configured to develop a model for image processing, with the model accounting for, for example, different watercraft shapes and sizes, device shapes and sizes for trolling motors, other motors, sonar transducer assemblies, and other devices, and common occurrences in certain bodies of water, among other things. In some embodiments, a marine electronic device 760 (see FIG. 7) may comprise one or more processors 710 (see FIG. 7) that perform the functions shown in FIG. 9.

The system may also obtain and utilize data regarding for the type of watercraft, demographic information about one or more users, the environment around the watercraft, various user actions on a display, a user interface, or some other action, etc. The developed model may assign different weights to different types of data that are provided.

In some systems, even after the model is deployed, the systems may beneficially improve the developed model by analyzing further data points. By utilizing artificial intelligence, effective image processing techniques may be implemented. Additionally, utilizing artificial intelligence, the image processing techniques may be performed with greater accuracy as the accuracy of object recognition and edge recognition may be greatly improved.

By receiving several different types of data, the example method 900 may be performed to generate complex models. The example method 900 may find relationships between different types of data that may not have been anticipated. The method 900 may identify relationships that are very difficult or impossible for a human to identify on their own. By detecting relationships between different types of data, the method 900 may generate accurate models even where a limited amount of data is available.

In some embodiments, the model may be continuously improved even after the model has been deployed. Thus, the model may be continuously refined based on changes in the systems or in the environment over time, which provides a benefit as compared with other models that stay the same after being deployed. The example method 900 may also refine the deployed model to fine-tune weights that are provided to various types of data based on subtle changes in the watercraft, devices on the watercraft, the environment, etc. In embodiments where an initial model is formed using data from multiple users and where the model is subsequently refined after being deployed based on data from a particular user, the data obtained after being deployed may be weighted more strongly than other data obtained before the model is deployed.

The method 900 may continuously refine a deployed model to quickly account for the changes and provide a revised model that is accurate. This may be particularly beneficial where certain parts of the watercraft are replaced, modified, or damaged or where there are swift changes in the environment. By contrast, where a model is not continuously refined, changes to the watercraft or the surrounding environment may make the model inaccurate until a new model may be developed and implemented, and implementation of a new model may be very costly, time-consuming, and less accurate than a continuously refined model. Continuous refinement may also be beneficial for novice users who may otherwise be unaware of changes that are occurring.

At operation 902, one or more data points are received. These data points may or may not be the initial data points being received. These data points preferably comprise known data on edge locations on objects within images, or some other characteristic that the model may be used to predict. The data points provided at operation 902 will preferably be historical data points with verified values to ensure that the model generated will be accurate. The data points may take the form of discrete data points. However, where the data points are not known at a high confidence level, a calculated data value may be provided, and, in some cases, a standard deviation or uncertainty value may also be provided to assist in determining the weight to be provided to the data value in generating a model. In this regard, the model predicted user preferences may be formed based on historical data.

For example, the model may be formed based on historical data regarding edge locations on objects within images and additional data regarding the watercraft, devices on the watercraft, the environment, etc. Additional data may be provided from a variety of sources, and additional data may, for example, be historical data from existing images where the actual edge locations for objects represented in the images are known. Historical data may also be provided by experts. However, historical data may be obtained in other ways as well. This model may be formed to predict the edge locations for objects represented in images, and this may be beneficial to allow the shape, size, and/or the orientation of the objects to be identified. A processor may be configured to utilize the developed model to perform image processing. This model may be developed through machine learning utilizing artificial intelligence. Alternatively, a model may be developed through artificial intelligence. A processor may be configured to use the model and input images.

At operation 904, a model is improved by minimizing error between data regarding predicted data regarding edge locations and actual data regarding edge locations. In some embodiments, an initial model may be provided or selected by a user. The user may provide a hypothesis for an initial model, and the method 900 may improve the initial model. However, in other embodiments, the user may not provide an initial model, and the method 900 may develop the initial model at operation 904, such as during the first iteration of the method 900. The process of minimizing error may be similar to a linear regression analysis on a larger scale where three or more different variables are being analyzed, and various weights may be provided for the variables to develop a model with the highest accuracy possible. Where a certain variable has a high correlation with the accuracy of data, that variable may be given increased weight in the model. In refining the model, the component performing the method 900 may perform a very large number of complex computations. Sufficient refinement results in an accurate model.

In some embodiments, the accuracy of the model may be checked. For example, at operation 906, the accuracy of the model is determined. This may be done by calculating the error between the model predicted outputs generated by the model and the actual outputs. In some embodiments, error may also be calculated before operation 904. By calculating the accuracy or the error, the method 900 may determine if the model needs to be refined further or if the model is ready to be deployed. Where the model predicted output is a qualitative value or a categorical value, the accuracy may be assessed based on the number of times the predicted value was correct. Where the model predicted output is a quantitative value, the accuracy may be assessed based on the difference between the actual value and the predicted value.

At operation 908, a determination is made as to whether the calculated error is sufficiently low. A specific threshold value may be provided in some embodiments. For example, where the model is used to predict the edge locations for a watercraft or a device on the watercraft, the error may be evaluated by determining the difference between the actual edge locations and the predicted edge locations. Alternatively, where the model is used to predict the edge locations for a watercraft or a device on the watercraft, the error may be evaluated by determining the percentage of times (e.g., 25%, 50%, 75%, 90%, 95%, etc.) where the model successfully predicts all edge locations of an object within an image within a specified error limit (e.g., 1 millimeter, 5 millimeters, 10 millimeters, etc.). However, other threshold values may be used, and the threshold value may be altered by the user in some embodiments. If the error rate is not sufficiently low, then the method 900 may proceed back to operation 902 so that one or more additional data points may be received. If the error rate is sufficiently low, then the method 900 proceeds to operation 910. Once the error rate is sufficiently low, the training phase for developing the model may be completed, and the implementation phase may begin where the model may be used to make predictions.

By completing operations 902, 904, 906, and 908, a model may be refined through machine learning utilizing artificial intelligence based on the historical comparisons. Notably, example model generation and/or refinement may be accomplished even if the order of these operations is changed, if some operations are removed, or if other operations are added.

After the model has been successfully trained, the model may be implemented as illustrated from operations 910-912. In some embodiments, the model may be modified (e.g., further refined) based on the received data points, such as at operation 914.

At operation 910, further data points are received. For these further data points, the data points provide actual data regarding edge locations for representations of objects within an image. At operation 912, the model may be used to provide a predicted output data value for the further data points. Thus, the model may be utilized to determine the edge locations for representations of objects within an image.

At operation 914, the model may be modified based on supplementary data points, such as those received during operation 910 and/or other data points. The system may account for data regarding edge locations for representation of objects within an image. By providing supplementary data points, the model may continuously be improved even after the model has been deployed. The supplementary data points may be the further data points received at operation 910, or the supplementary data points may be provided to the processor(s) from some other source. In some embodiments, the processor(s) or the other component performing the method 900 may receive additional data and verify the further data points received at operation 910 using this additional data. By doing this, the method 900 may prevent errors in the further data points from negatively impacting the accuracy of the model.

In some embodiments, supplementary data points may be provided to the processor from some other source and are utilized to improve the model. For example, supplementary data points may be saved to a memory 720 (see FIG. 7) associated with at least one processor 710 (see FIG. 7) via communication interface 778 (see FIG. 7), or the supplementary data points may be sent through the external network 702 (see FIG. 7) from a remote device 754 (see FIG. 7). These supplementary data points may be verified before being provided to the processor(s) 710 to improve the model, or the processor(s) 710 may verify the supplementary data points utilizing additional data.

As indicated above, in some embodiments, operation 914 is not performed and the method proceeds from operation 912 back to operation 910. In other embodiments, operation 914 occurs before operation 912 or simultaneously with operation 912. Upon completion, the method 900 may return to operation 910 and proceed on to the subsequent operations. Supplementary data points may be the further data points received at operation 910 or some other data points.

The methods 800, 900 illustrated in FIGS. 8-9 are merely provided for the purposes of illustration, and the operations presented in methods 800, 900 may be performed in other orders. The operations in each of methods 800, 900 may be performed simultaneously. Additionally, some operations presented in methods 800, 900 may be omitted, and certain operations not presented in methods 800, 900 may be added.

CONCLUSION

Many modifications and other embodiments set forth herein will come to mind to one skilled in the art to which these embodiments pertain having the benefit of the teachings presented in the foregoing descriptions and the associated drawings. Therefore, it is to be understood that the embodiments are not to be limited to the specific embodiments disclosed and that modifications and other embodiments are intended to be included within the scope of the invention. Moreover, although the foregoing descriptions and the associated drawings describe example embodiments in the context of certain example combinations of elements and/or functions, it should be appreciated that different combinations of elements and/or functions may be provided by alternative embodiments without departing from the scope of the invention. In this regard, for example, different combinations of elements and/or functions than those explicitly described above are also contemplated within the scope of the invention. Although specific terms are employed herein, they are used in a generic and descriptive sense only and not for purposes of limitation.

What is claimed is:

1. A system for determining an angular offset for a device attached to a watercraft, the system comprising:
- an electronic device including a camera;
- one or more processors; and
- a memory including computer program code configured to, when executed, cause the one or more processors to:
  - determine, based on an image via the camera, a first direction associated with the watercraft, wherein the image includes at least a portion of the watercraft and at least a portion of the device mounted to the watercraft;
  - determine, based on the image via the camera, a second direction associated with the device;
  - determine an angular offset between the first direction and the second direction, wherein the angular offset is displayed as lines or other indicia illustrating an angle overlaying the portion of the watercraft and the portion of the device in the image; and
  - store an indication of the angular offset in the memory for use with one or more functions associated with the device.

2. The system of claim 1, wherein the computer program code is configured to, when executed, cause the one or more processors to determine the first direction associated with the watercraft and determine the second direction associated with the device based on a still image taken by the camera.

3. The system of claim 1, wherein determining the first direction associated with the watercraft based on the image is accomplished using image processing.

4. The system of claim 3, wherein determining the first direction associated with the watercraft is performed using a Hough transform.

5. The system of claim 4, wherein the Hough transform uses points on the watercraft to determine the first direction associated with the watercraft, and the points on the watercraft are positioned on a bow of the watercraft.

6. The system of claim 3, wherein the one or more processors are configured to utilize a model when using the image processing to determine the first direction associated with the watercraft based on the image, the model is formed based on historical comparisons of historical shape data for a watercraft or a device and historical additional data, and the model is developed through machine learning utilizing artificial intelligence.

7. The system of claim 1, wherein the device is a component of a trolling motor assembly, and the second direction is a forward direction of the component of the trolling motor assembly extending outwardly from the watercraft.

8. The system of claim 1, wherein of the angular offset is displayed with text to the user indicating an amount of the angular offset.

9. The system of claim 1, wherein the lines or other indicia are displayed on a live image showing the device.

10. The system of claim 1, wherein the electronic device is at least one of a cell phone, a tablet, a laptop, a smart watch, or smart glasses.

11. The system of claim 1, wherein the image is taken from a position above the device.

12. The system of claim 1, wherein the device is a sonar transducer, the first direction associated with the watercraft is a rearward direction of the watercraft, and the second direction is a pointing direction of the sonar transducer extending outwardly from the watercraft.

13. An electronic device for determining an angular offset for a device attached to a watercraft, the electronic device comprising:
- a camera;
- one or more processors; and
- a memory including computer program code configured to, when executed, cause the one or more processors to:
  - determine, based on an image via the camera, a first direction associated with the watercraft, wherein the image includes at least a portion of the watercraft and at least a portion of the device mounted to the watercraft;
  - determine, based on the image via the camera, a second direction associated with the device;
  - determine an angular offset between the first direction and the second direction, wherein the angular offset is displayed as lines or other indicia illustrating an angle overlaying the portion of the watercraft and the portion of the device in the image; and store an indication of the angular offset in the memory for use with one or more functions associated with the device.

14. The electronic device of claim 13, wherein the electronic device is at least one of a cell phone, a smart phone, a tablet, a laptop, a smart watch, or smart glasses.

15. The electronic device of claim 13, wherein the computer program code is configured to, when executed, cause the one or more processors to determine the first direction associated with the watercraft and determine the second direction associated with the watercraft based on a still image taken from the camera.

16. The electronic device of claim 13, wherein determining the first direction associated with the watercraft based on the image is accomplished using image processing.

17. The electronic device of claim 16, wherein determining the first direction associated with the watercraft is performed using a Hough transform.

18. A method for determining an angular offset for a device attached to a watercraft, the method comprising:

determining, based on an image via the camera, a first direction associated with the watercraft, wherein the image includes at least a portion of the watercraft and at least a portion of the device mounted to the watercraft;

determining, based on the image via the camera, a second direction associated with the device;

determining an angular offset between the first direction and the second direction, wherein the angular offset is displayed as lines or other indicia illustrating an angle overlaying the portion of the watercraft and the portion of the device in the image; and storing an indication of the angular offset in the memory for use with one or more functions associated with the device.

19. The method of claim 18, further comprising:

determining the first direction associated with the watercraft and determining the second direction associated with the watercraft based on a live image from the camera.

* * * * *